US008098024B1

(12) United States Patent
Gordin

(10) Patent No.: US 8,098,024 B1
(45) Date of Patent: Jan. 17, 2012

(54) APPARATUS AND METHOD FOR DISCRETIONARY ADJUSTMENT OF LUMEN OUTPUT OF LIGHT SOURCES HAVING LAMP LUMEN DEPRECIATION CHARACTERISTIC COMPENSATION

(75) Inventor: Myron Gordin, Oskaloosa, IA (US)

(73) Assignee: Musco Corporation, Oskaloosa, IA (US)

( * ) Notice: Subject to any disclaimer, the term of this patent is extended or adjusted under 35 U.S.C. 154(b) by 0 days.

(21) Appl. No.: 13/092,674

(22) Filed: Apr. 22, 2011

Related U.S. Application Data

(60) Division of application No. 11/842,853, filed on Aug. 21, 2007, now Pat. No. 7,956,551, which is a continuation-in-part of application No. 11/559,153, filed on Nov. 13, 2006, now Pat. No. 7,675,251, which is a division of application No. 10/785,867, filed on Feb. 24, 2004, now Pat. No. 7,176,635.

(51) Int. Cl.
*H05B 37/02* (2006.01)

(52) U.S. Cl. ..... 315/291; 315/307; 315/308

(58) Field of Classification Search ..... 315/312, 315/313, 316, 314, 315, 320, 291, 307, 308
See application file for complete search history.

(56) References Cited

U.S. PATENT DOCUMENTS

| | | | |
|---|---|---|---|
| 4,005,336 | A | 1/1977 | Casella |
| 4,009,387 | A | 2/1977 | Nuver |
| 4,189,664 | A | 2/1980 | Hirschfeld |
| 4,292,570 | A | 9/1981 | Engel |
| 4,434,388 | A | 2/1984 | Carver et al. |
| 4,442,382 | A | 4/1984 | Fleck |
| 4,475,065 | A | 10/1984 | Bhalla et al. |
| 4,501,994 | A | 2/1985 | Spreadbury |
| 4,725,934 | A | 2/1988 | Gordin |
| 4,816,974 | A | 3/1989 | Gordin |
| 4,891,562 | A | 1/1990 | Nuckolls |
| 4,924,109 | A | 5/1990 | Weber |
| 4,931,701 | A | 6/1990 | Carl |

(Continued)

FOREIGN PATENT DOCUMENTS

CA 1288803 9/1991

(Continued)

OTHER PUBLICATIONS

International Search Report for PCT/US2005/005688, International Filing Date Feb. 23, 2005, 3 pages.

(Continued)

*Primary Examiner* — David Hung Vu
(74) *Attorney, Agent, or Firm* — McKee, Voorhees & Sease, P.L.C.

(57) ABSTRACT

A method, apparatus, and system for compensating for lamp lumen depreciation and providing selective discretionary lamp power adjustment, e.g., for lamp dimming. The method includes operating the lamp under rated wattage for a period towards the first part of operating life of the lamp. Operating wattage is increased at one or more later times. Energy savings are realized. The increases also restore at least some light lost by lamp lumen depreciation. The apparatus uses a timer to track operating time of the lamp. A few wattage changes made at spaced apart times can be made in a number of ways, including changing capacitance to the lamp, or using different taps on the lamp ballast. A component allows selective discretionary adjustment of electrical power or some other controlling factor to adjust light output (e.g. dim) the lamp.

23 Claims, 18 Drawing Sheets

U.S. PATENT DOCUMENTS

| | | | | |
|---|---|---|---|---|
| 4,947,303 | A | 8/1990 | Gordin | |
| 4,994,718 | A | 2/1991 | Gordin | |
| 5,068,576 | A * | 11/1991 | Hu et al. | 315/291 |
| 5,075,828 | A | 12/1991 | Gordin | |
| 5,103,143 | A | 4/1992 | Daub | |
| 5,134,557 | A | 7/1992 | Gordin | |
| 5,161,883 | A | 11/1992 | Gordin | |
| 5,229,681 | A | 7/1993 | Gordin | |
| 5,391,966 | A | 2/1995 | Garrison | |
| 5,434,763 | A | 7/1995 | Hege et al. | |
| 5,442,261 | A | 8/1995 | Bank | |
| 5,469,027 | A | 11/1995 | Uchihashi et al. | |
| 5,475,360 | A | 12/1995 | Guidette et al. | |
| 5,519,286 | A | 5/1996 | Rodrigues et al. | |
| 5,856,721 | A | 1/1999 | Gordin | |
| 6,031,340 | A | 2/2000 | Brosius | |
| 6,075,326 | A | 6/2000 | Nostwick | |
| 6,114,816 | A | 9/2000 | Nuckolls | |
| 6,150,772 | A | 11/2000 | Crane | |
| 6,172,469 | B1 | 1/2001 | Kern | |
| 6,191,568 | B1 | 2/2001 | Poletti | |
| 6,207,943 | B1 | 3/2001 | Smelker | |
| 6,215,254 | B1 | 4/2001 | Honda et al. | |
| 6,316,923 | B1 | 11/2001 | Poletti | |
| 6,320,323 | B1 | 11/2001 | Buell | |
| 6,373,201 | B2 | 4/2002 | Morgan | |
| 6,376,996 | B1 | 4/2002 | Olson | |
| 6,501,231 | B1 | 12/2002 | Hyland | |
| 6,515,430 | B2 | 2/2003 | Kayser | |
| 6,545,429 | B1 | 4/2003 | Flory, IV | |
| 6,545,433 | B2 | 4/2003 | Beij | |
| 6,577,075 | B2 | 6/2003 | Romano et al. | |
| 6,583,574 | B2 | 6/2003 | Ann | |
| 6,681,110 | B1 | 1/2004 | Crookham et al. | |
| 6,798,153 | B2 | 9/2004 | Mattos et al. | |
| 7,002,305 | B2 * | 2/2006 | Kambara et al. | 315/291 |
| 7,176,635 | B2 | 2/2007 | Gordin | |
| 7,385,360 | B2 | 6/2008 | Dluzniak | |
| 7,675,251 | B2 | 3/2010 | Gordin | |
| 2002/0089293 | A1 | 7/2002 | Romano et al. | |
| 2002/0185980 | A1 | 12/2002 | Beij et al. | |
| 2003/0025463 | A1 | 2/2003 | Mattas et al. | |
| 2003/0090215 | A1 | 5/2003 | Beasley | |
| 2006/0071610 | A1 | 4/2006 | Dluzniak | |
| 2007/0040513 | A1 | 2/2007 | Cleland et al. | |
| 2007/0043540 | A1 | 2/2007 | Cleland | |
| 2007/0043541 | A1 | 2/2007 | Cleland et al. | |
| 2007/0070571 | A1 | 3/2007 | Gordin et al. | |

FOREIGN PATENT DOCUMENTS

| | | | |
|---|---|---|---|
| DE | 195 40 326 | A1 | 4/1997 |
| DE | 199 12 517 | A1 | 9/2000 |
| EP | 0 439 358 | A2 | 1/1991 |
| EP | 0 536 877 | A1 | 4/1993 |
| EP | 0 669 788 | A1 | 8/1995 |
| JP | 6163163 | A | 6/1994 |
| JP | 9-180886 | | 10/1996 |
| TW | I148059 | | 12/1990 |
| TW | I230912 | | 4/2005 |
| WO | WO 2005/084086 | A1 | 9/2005 |

OTHER PUBLICATIONS

Venture Lighting International, Range of Metal Halide Maintenace, HID Systems Sourcebook, 2000, p. 143).
Gordin, Co-Pending U.S. Appl. No. 11/842,853, filed Aug. 21, 2007.
Musco, "Multi-Watt allows two light levels, reduce energy costs", copyright 1992, 2002 Musco Lighting, (4 pages).
Venture Lighting, Venture Technical Information, Ballasts, © 2006 and Ballast Types ©2006 (6 pages).
English abstract of JP 9180886 (1 page), Oct. 28, 1996.
English translation of DE 19912517 (8 pages), Sep. 21, 2000.
English translation of DE 19540326 (13 pages), Apr. 30, 1997.
English Abstract of JP 6163163A (1 page), Jun. 10, 1994.
English Abstract of DE 199 12 517 (1 page), Sep. 21, 2000.
English Abstract of DE 195 40 326 A1 (1 page), Apr. 30, 1997.
English Abstract of EP 0 669 788 (1 page), Aug. 30, 1995.
English Abstract of WO 2005/084086 (1 page), Sep. 9, 2005.
English translation of Taiwan I230912, (23 pages), Apr. 11, 2005.
English translation of Taiwan 148059 (56 pages), Dec. 21, 1990.

* cited by examiner

NOTE: OVERLAPPING CONTACTS
S1-2 CLOSES BEFORE S1-1 BREAKS
S2-2 CLOSES BEFORE S2-1 BREAKS
S3-2 CLOSES BEFORE S3-1 BREAKS

APPARATUS AND METHOD FOR DISCRETIONARY ADJUSTMENT OF LUMEN OUTPUT OF LIGHT SOURCES HAVING LAMP LUMEN DEPRECIATION CHARACTERISTIC COMPENSATION

CROSS REFERENCE TO RELATED APPLICATIONS

This application is a Divisional Application of U.S. Ser. No. 11/842,853 filed Aug. 21, 2007, now U.S. Pat. No. 7,956,551, which is a Continuation-in-Part from U.S. Ser. No. 11/559,153 filed Nov. 13, 2006, now U.S. Pat. No. 7,675,251 issued on Mar. 9, 2010, which is a divisional of U.S. Ser. No. 10/785,867 filed Feb. 24, 2004, now U.S. Pat. No. 7,176,635 issued Feb. 13, 2007, all of which are incorporated herein in their entireties.

INCORPORATION BY REFERENCE

The contents of the following U.S. Patents are incorporated by reference in their entireties: U.S. Pat. Nos. 7,176,635; 6,681,110; and 4,994,718.

I. BACKGROUND OF THE INVENTION

A. Field of Invention

The present invention relates to light sources which exhibit lumen depreciation over their operating lives and, in particular, to methods, apparatus, and systems for operating such light sources to compensate, at least partially, for such lumen depreciation, reduce costs, and save energy. In one aspect, the added option of end-user-defined discretionary adjustment of lumen output of the light source or multiple light sources is included. Discretionary adjustment allows such things as, for example, dimming of light level from one or more fixtures at selected times or circumstances while maintaining some form of non-end-user-defined lamp lumen depreciation compensation.

B. Problems in the Art

Most high intensity discharge (HID) lamps exhibit what is called lamp lumen depreciation (LLD) characteristic. HID lamps include, but are not limited to, fluorescent, sodium (HPS), metal halide (MH), mercury vapor (HgV), and low pressure sodium (LPS). Each of these specifically mentioned types of HID lamps require a ballast transformer that regulates the operating and starting voltage at the lamp. Many other light sources likewise have some type of LLD, including but not necessarily limited to solid state, fluorescent, halogen, and incandescent sources.

One definition of lumen depreciation or LLD is the gradual decline in a source's light output over operation time. Light output from the light source does not stay constant if operated at rated operating wattage. Due to several factors, primarily blackening of the inside of the arc tube from precipitation of chemicals and erosion of electrodes, light output usually drops as the lamp is operated. This characteristic is well known in the art. For example, a typical 1500 W MH lamp can lose up to around 50% of its light output over a typical 3000 hour cumulative operation life. See, for example, the graph of FIG. 1. Interestingly, in some lamps (including many MH lamps), lumen depreciation occurs most rapidly during the first several hundred hours of operation (e.g. 20% light loss). The rate of depreciation slows thereafter (e.g. sometimes on the order of another 10% loss for each subsequent 1000 operating hours). But cumulatively, relative to initial light output, the lamp will lose about one-half of its light-producing capacity by end of its rated life.

Manufacturers give HID lamps a rated operating wattage (ROW). ROW is the recommended wattage to operate the lamp. Manufacturers do not recommend operation substantially over ROW, as they indicate a belief it could cause failure or, at least, reduce useful life of the lamp. They indicate operation at the ROW will provide the most efficient and long-lasting operation of the lamp.

Operation substantially under ROW is also not recommended because starting the lamp can be a problem. The arc may simply drop out without sufficient power. Also, operation too far below rated wattage can materially affect efficacy of the lamp. It can also reduce light output so much as to make use of the lamp impractical for its cost. Other possible detrimental effects on the lamp or its light output are believed possible.

For example, manufacturers' generally recommend a 1500 W MH lamp not be operated at more than 1750 W (about 15 to 20% above ROW) or less than 1000 W (about 30 to 35% below ROW).

Although LLD is different for each lamp (even lamps of the same type, ROW, and manufacturer), the characteristic is well known and is fairly predictable for the same type of lamps. LLD for a particular lamp can usually be found in the technical information available from manufacturers. Sometimes LLD is expressed in terms of a multiplier factor (lumen depreciation factor or LDF) that can be used in illumination calculations to predict reduction in the light output of a lamp over a period of time caused by lumen depreciation. The LDF is usually determined by dividing the maintained lamp lumens by the published initial lamp lumens, usually yielding a value of less than 1. The LDF therefore is used in the industry as an indication of how much light loss from LLD can be expected for a lamp over its operating life.

Other factors, in addition to lumen depreciation, can contribute to what is called total light loss factor for a light fixture. Some of these factors do not involve operation of the lamp itself, such as ballast factor, ambient fixture temperature, supply voltage variation, optical factor, and surface fixture depreciation. But LLD is a significant contributor to total light loss factor.

A particular example of the LLD problem can be given in the context of sports lighting. MH lamps are commonly used, usually having ROWs on the order of at least 700 or 800 watts, and more frequently 1,000 watts, 1,500 watts, or higher. Lamp ROW gives an indication of how much electrical power is needed to run them at a specified operating voltage. Light or lumen output of a lamp is a function of wattage. For example, a 1500 W MH lamp (product ordering code MH1500/U) from Philips Lighting, a division of Philips Electronics N.V. outputs about 155,000 lumens initial and 124,000 mean lumens when operated at 1500 W. A 1000 W MH Philips lamp (product ordering code MH1000/U) outputs about 105,000 lumens initial and 66,000 mean lumens. Wide area, outdoor lighting systems presently tend to favor 1000 W to 1500 W lamps because of the larger light output. Lamps over 1500 W are becoming increasingly available and used.

With reference to FIG. 5, wide area outdoor lighting, such as is used in sports field lighting to illuminate outdoor sports fields, typically utilizes several sets or banks 16 of HID luminaires 14 (each including an HID lamp 10) to illuminate not only field 24, but a volume of space above the field, to make it playable for the players and watchable from spectator stands 26 for different sports. The conventional approach is to mount lighting fixtures 14 in sets 16 on tall poles 18. A common type of lighting fixture or luminaire 14 includes a relatively high wattage high intensity discharge (HID) lamp 10 mounted in an aluminum reflector 12. Electrical power 22 is supplied via conductive cables to ballasts in ballast boxes 20, which distribute electrical power to each lamp 10. Most times a light level is specified for the field. The lighting must be designed to meet such light levels by the selection of number of fixtures (based on light output from such fixtures, which is primarily dependent upon the lamp selected), the size and type of reflector, and their aiming directions to the field. These issues are well known in the art, as are a variety of methods of selection and design of lighting configurations to meet a specified light level. Recommended levels of illumination exist for visibility and safety for various size, shape, and type of sports fields. Light levels that are too low raise not only visibility issues, but also safety considerations. For example, low or uneven light levels can make it difficult for a player to see a fast moving ball.

Theoretically, there can be almost an infinite number of ways to light a field to a specified light level. For example, a thousand fixtures could be elevated on poles or other superstructures and densely packed together encircling the field. However, this is usually impractical. Not only would the cost of that many fixtures (including lamps) be high, the cost of structures to elevate them would be likewise. The cost of maintenance would also be high. And, over time, the cost of energy to operate them would be high. Since many, if not most, athletic field lighting systems are funded by the public or non-profit organizations (e.g. schools, municipal recreation departments, private recreation leagues), cost is a major factor in selecting such lighting.

Therefore, it is conventional to try to minimize the structure used to elevate fixtures and also minimize the number of fixtures for a lighting application to reduce both capital and operating costs. This has driven HID lamp manufacturers to develop more powerful lamps so that each fixture can output greater amounts of light energy to, in turn, allow less fixtures to meet a specified light level for a field. Less fixtures allows less elevating structure (e.g. less poles). For example, it has been reported that capital costs for installations with 1000 W fixtures can be at least 30 percent higher over installations with 1500 W fixtures.

However, as previously discussed, MH lamps (and most HID lamps), have an initial light output at rated wattage (after an initial "break in" period), but then, over the life of an HID lamp, the lamp usually slowly loses lumen output from LLD, even if that same level of electrical power or rated wattage is supplied. The practical effect of lumen depreciation is that, by the latter part of normal operating life of the lamp, its light output is a fraction of its starting output. If used in a system which requires a specified light level or output from the light source, the light source may have to be replaced early because it alone, or in combination with other lamps of similar reduced output, may render the light level to the target unacceptable.

One way of dealing with LLD is to do nothing. Even though the LLD characteristic will most likely result in a drop in light level from the light source, in many lighting applications it is not considered worth addressing. The drop in light level over time is simply accepted, or is not deemed significant enough, functionally or economically, to act upon. With HID lamps, the initial rapid drop-off is usually no more than 10-20%. And, subsequent light loss from LLD tends to proceed at a slower rate after that rapid initial lumen depreciation period. The lumen drop-off may not even be noticeable to most observers. However, in applications where light output is specified for a light source or for the area or target to be lighted by the light source, as is the case for wide area sports lighting, lumen depreciation can be a significant problem. As stated, in sports lighting, if light levels drop too much, it can not only be more difficult for spectators to see the activity on the field, it can become dangerous for players. Thus, doing nothing to compensate for LLD is not satisfactory for such lighting applications.

A second approach to the LLD issue is to replace lamps well prior to end of predicted operating life. For example, some specifications call for all lamps to be replaced at 40% of predicted life. While this tries to deal with the light loss from LLD, replacing lamps early during expected life span adds significant cost to the lighting system, and wastes potential usefulness of some lamps.

If lumen depreciation is dealt with in sports lighting, however, the most common way is a third approach, as follows. The designs essentially engineer into the system an excess amount of light fixtures (and thus additional lamps) in anticipation of light output drop-off caused by at least the first, rapid 10-20% depreciation, so that after about 100-200 hours of operation, the light output is at about the specified level for the particular application. These designs conventionally specify that the lamps be operated at rated operating wattages. The excess fixtures, and the higher energy use, add cost to the system (capital and energy) compared to less fixtures (and less lamps), but try to compensate (at least initially) for light loss from LLD. Also, this way of dealing with LLD does not add additional components, and the associated cost, to the lamps, or to their luminaires or electrical circuitry. It simply adds additional conventional lamps and fixtures. Therefore, a light designer typically selects a type and number of conventional HID lamps and fixtures that cumulatively may initially exceed the lighting requirements because the designer knows that, over time, the lumen depreciation will drop the lighting level below recommended standards. However, after the initial rapid LLD period, lumen levels decrease (somewhat slowly), but will normally gradually move below the recommended light levels. This latter LLD (after the first more rapid LLD) is many times not adequately accounted for in system design, or is ignored.

Designers may use a lumen depreciation factor or LDF to help decide how much excess light to initially produce. This tries to factor in predicted LLD light loss over whole lamp life, but only uses averages. This approach still uses a number of fixtures which initially produce excess light, but later may not produce enough light. As can be appreciated, this results in added capital and energy costs initially, and added energy and maintenance costs thereafter (e.g. operating additional lamps at ROW over their entire operating lives, and having to replace more lamps over time). It also may result in a deficiency of light later. But this has been the conventional balance adopted by the state of the art.

The state of the art has, therefore, moved in the direction of developing and using higher wattage lamps, and intentionally designing in additional fixtures that produce an initial excess amount of initial light output for an application. This addresses part of the LLD issue, but not all of it. It does not address added cost (capital and operation). Therefore, there is room for improvement in the art.

There are also continuing attempts to make other improvements involving HID lighting. For example, improvements have been made in increasing the efficiency of lighting fixtures to direct more light from each lamp to the field, see, e.g., U.S. Pat. Nos. 4,725,934, 4,816,974, 4,947,303, 5,075,828, 5,134,557, 5,161,883, 5,229,681, and 5,856,721. But, the problem of light loss from lumen depreciation of HID lamps remains a problem in the art.

Special ballasts have also been developed, particularly for fluorescent lamps, to try to keep light output from a lamp uniform over its life. However, these tend to be relatively complex, require significant interfacing components or circuitry with the lighting system, and therefore are relatively expensive and impractical. They also do not address the issues of composite lighting by sets of fixtures, as exists in lighting such as sports lighting or other composite area lighting. Therefore special ballasts of the type mentioned are generally considered too expensive for use in most lighting applications.

The above-mentioned types of sports-related HID lighting systems usually simultaneously operate a number of relatively high wattage lamps (e.g. over 1000 watts), and are operated frequently over many years of normal useful life. While energy usage and costs over short periods of time are not huge, over many hours of operation they add up. Other types of lights and/or lighting applications can have analogous issues. For example, many hundreds or thousands of interior office lights operated over many hours of time consume substantial amounts of electrical energy.

As is well-known in the art, many lighting applications must comply with minimum lighting requirements in terms of lumen output from fixtures or, more frequently, light intensity and uniformity relative to the area or space to be lighted. In some cases, the same target space or area may have different minimum lumen or light intensity/uniformity requirements for different times, circumstances, or events. Also, a minimum level may not be needed for all situations or times. However, many lighting systems only operate with one level of lumen output at any particular time. Unneeded light is therefore sometimes provided, and energy and light are wasted.

As discussed previously, many light sources exhibit the LLD characteristic. The lumen output of these light sources decays over time. Light apparatus and system providers often over-light a target space or area by a large margin for a significant period of a light source's anticipated life span so that, as the light source degrades, supplied light levels will not drop below acceptable parameters or levels for at least an acceptable period of time. Over-lighting an application has a plurality of drawbacks, most notably the added costs associated with extra fixtures, light sources, and energy needed to provide adequate light for an acceptable period of time before lumen depreciation drops lumen output below acceptable levels.

There are lighting situations where it would be beneficial to at least have the option of discretionarily or selectively adjusting the lumen output of one or more lamps in such lighting systems, even relatively briefly. For example, this can be desirable for the purpose of decreasing temporarily the level of illumination to a target area or space for the lighting system and/or reducing power consumption, and thus cost of operation, of the system. Reasons for adjusting lamp output can vary and can be different from wanting to compensate for LLD.

There are also lighting applications which have more general and undefined lighting requirements. These applications can also benefit from having flexibility in discretionary selection of lumen output levels for a variety of reasons, including but not limited to, energy savings, aesthetics, and color dynamic in the case of colored light sources.

One known example of discretionary HID light dimming is the MULTI-WATT® technology available commercially from Musco Corporation of Oskaloosa, Iowa USA, details of which can be found at U.S. Pat. No. 4,994,718. It discloses manual switching between levels of capacitance to select different operating powers for, and thus different lumen outputs from, the lamp. MULTI-WATT® circuits enable selective and discretionary dimming of lights. In one example, capacitance is added or deleted to change light output from one or more lamps. This provides a user, in the user's discretion, the option to select, at any time, between more or less light to the target. However, it does not address compensation for LLD.

There are a number of ways suggested in related art for varying power to a ballasted lamp. There are also ways suggested in related art of varying power levels to high intensity lamps. For example, circuits are known for streetlights that turn down operating power at a pre-selected time each day (e.g. after midnight). However, there is a need in the art to address the combination of discretionary power adjustment for selective variation of light output as well as LLD compensation.

As can be appreciated, functions like those of MULTI-WATTT™ are directed at a different concept—discretionary adjustment of operating power to a light source—than adjustment for LLD compensation purposes. Therefore, the concepts are divergent and directed at different issues. However, there are benefits in having such divergent concepts available in one lighting system or for one light source.

II. SUMMARY OF THE INVENTION

A. Objects, Features, Advantages and Aspects of the Invention

It is therefore respectfully submitted that a primary object, feature, advantage or aspect of the present invention is to provide a method, apparatus, or system to improve over the state of the art. Further objects, features, advantages or aspects of the invention include a method, apparatus or system which:

a. over time, is aimed at saving energy, in certain circumstances on the order of 10-15% over conventional lighting systems.
b. is practical.
c. is cost effective—it may increase initial cost because components must be added, but more than recover those costs from energy savings over the life of many lamps.
d. is non-complex and does not require expensive, complex added components.
e. may extend life of lamp (because of operation at lower initial wattage).
f. may allow reduction in size, power, or number of light sources and/or fixtures for a given lighting application.
g. does not interfere with other parts of the lighting system.
h. if fails, does not affect other parts of the lighting system.
i. provides more consistent light output over the lamp's normal operating life, day to day, and year to year.
j. is applicable to a variety of lamps, fixtures, and applications.

These and other objects, features, advantages, and aspects of the invention will become more apparent with reference to the accompanying specification and claims.

Other objects, features, advantages, or aspects of the invention include an apparatus, method, or system for discretionary adjustment of light output from one or more fixtures with lamps that exhibit LLD which provides one or more of the following:

a. meets lighting needs and can use less energy.
b. is cost effective, in that initial implementation costs can be offset by realized savings in energy costs.
c. is practical.

d. may extend the life of the light source due to operating at lower power.
e. is applicable to a variety of lamps, fixtures, and applications.
f. can supply light at a number of lumen output levels.
g. can compensate, at least partially, for lumen depreciation.
h. provides flexibility for different lighting needs.
i. can reduce environmental impact of the lighting.
j. can reduce delays in switching between light output levels.

B. Summary of Aspects of the Invention

Therefore, the inventors identified a need in the art to minimize use of electrical power over at least a substantial portion of operational life of HID lamps, while reasonably compensating for LLD over the life of the lamp in a practical way. In one aspect of the invention, this is accomplished as follows.

(1) An HID lamp is selected for a given lighting application.
(2) At some point relatively near the first part of the initial operating hours of the HID lamp (either immediately or after a warm-up or break-in of several hours to perhaps one hundred hours of operation), the amount of electrical operating power to the lamp is reduced below the rated operating wattage of the lamp. By a priori knowledge or empirical methods, the wattage to the lamp is reduced, preferably not below what will produce an amount of light that is acceptably close to a desired or specified light level for the application (e.g. the amount specified to illuminate a field adequately according to guidelines).
(3) At a later predetermined time (again, from a priori knowledge or empirical data), wattage to the lamp is increased in an amount to approximately return lumen output to a level that will illuminate the target at or about the initially specified level. Many times, this increase is less than the initial operating wattage decrease. Many times, the increase is substantially spaced in time (e.g. several hundred hours) from the initial decrease.

Because the lumen depreciation can be fairly well predicted, the relationship between wattage and lumen output can be predicted. Thus, less electrical power is used initially, and LLD compensation is accomplished by one or more increases in wattage to bump light level back to or near desired level during the operational life of the lamp. This saves energy by using lower wattage in the beginning and not using additional wattage until needed to restore lumen output.

Optionally, at subsequent later times, further increases in wattage can be made to return lumen output to at or near the specified level to compensate for LLD. Thus, there can be several increases over the life of the lamp. Preferably, however, there are not more than a few.

In one aspect of the invention relating to sport lighting, the invention attempts to avoid using excess electrical power during a first period of operation (the light(s) will put out approximately what is needed for the field) by initially supplying operating wattage at a level lower than rated wattage for the lamp. Periodically, the wattage will be increased to combat the reduction in lumen output. While the increase in wattage can be done periodically, in one aspect of the invention, it will be done at no more than a handful of intermittent (not necessarily equally spaced) times. One way to designate the times for increases is to use a timer that monitors cumulative operating time of the lamp and, at pre-selected times, changes the taps on the lamp's electrical ballast to increase the amount of current to the lamp. Another way is to add capacitance. Other ways are possible.

Another aspect of the invention includes a method, apparatus, and system for cost and energy savings for lighting applications using one or more lamps having a LLD characteristic by operating a lamp under ROW for a given time period and then incrementally increasing operating wattage towards ROW between one and a few times over normal operating life of the lamp. This aspect also tends to provide a more consistent light level for the application.

Another aspect of the invention relates to providing for lighting apparatus or systems which can allow for greater flexibility in terms of lumen output, more consistent lumen output, use of less energy, and/or extended life of a light source. In one such aspect, this is accomplished as follows. A light source with a known LLD characteristic and whose lumen output is at least partially dependent on one or more controllable factor[s] (as defined herein) is selected for a particular application. From an analysis of a particular application or from a third party source, lighting requirements for the lighting application are identified. These lighting requirements may include, but are not limited to, one or more of a GMLR (as defined herein) for lumen output, alternate minimum lumen output levels, lighting levels which require lumen depreciation compensation, maximum lumen outputs, or the point at which the light source is deemed no longer functional and must be replaced. A set of one or more initial lumen output level[s] and the corresponding setting[s] for the controllable factor[s] are identified. The light source is connected such that there is an actuator (as defined herein) which can adjust the controllable factor[s] and can be switchably or otherwise operated to obtain desired lumen output level[s]. For level[s] which will implement LLD compensation, a minimum lumen output point or level is identified. This is the point where the controllable factor[s] will be adjusted by at least one actuator to return the lumen output to, or near to, the original or desired output for that level. A timer[s] is operatively connected such that at least one actuator is signaled or informed at these operating times when the light source is predicted to fall to or below minimum lumen output levels. This process is repeated for as many corrections as is decided to be necessary for each level. This aspect can result in significant energy, and therefore cost, savings due to the implementation of lumen depreciation compensation, discretionary switchable lower levels of operation, or both. In the case of lumen depreciation compensation, a light source can be operated within an envelope of power levels which includes levels above and below its rated or nominal wattage.

In one aspect of this discretionary switchable lighting with LLD compensation, one or more lamps or light sources having an LLD characteristic have the capability of being run at a first lumen output level with automatic LLD compensation by periodic increases in operating power to the lamp correlated with LLD for the lamp, but with the additional capability of allowing selective dimming of the lamp. This allows greater flexibility in operation and energy usage.

III. BRIEF DESCRIPTION OF THE DRAWINGS

Figure 14:
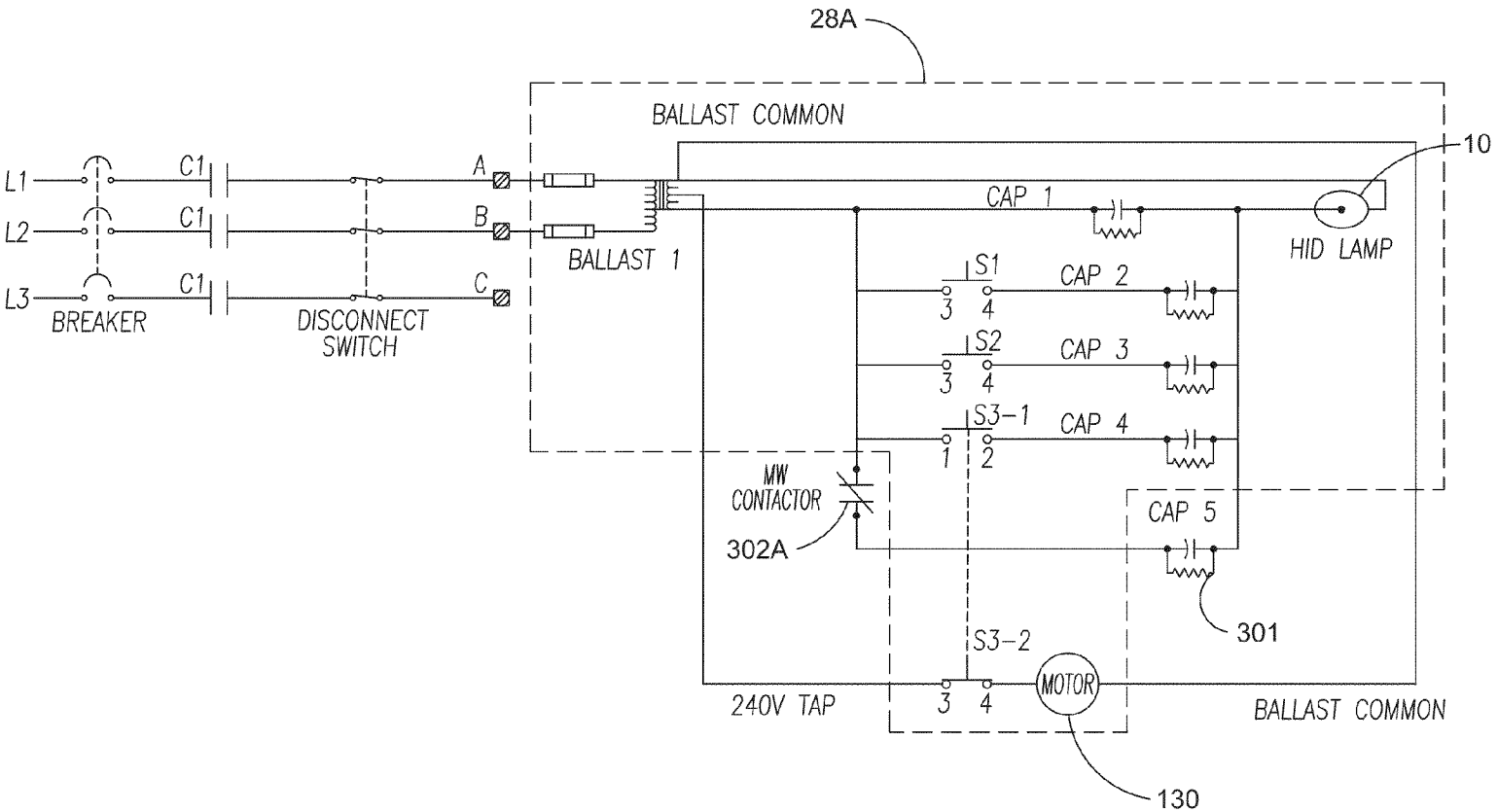
FIG. 14 is an example of an optional alternative exemplary embodiment implementing lumen depreciation compensation for multiple discretionary lumen output levels for the Smart Lamp™ system of FIG. 6.
Figure 15:
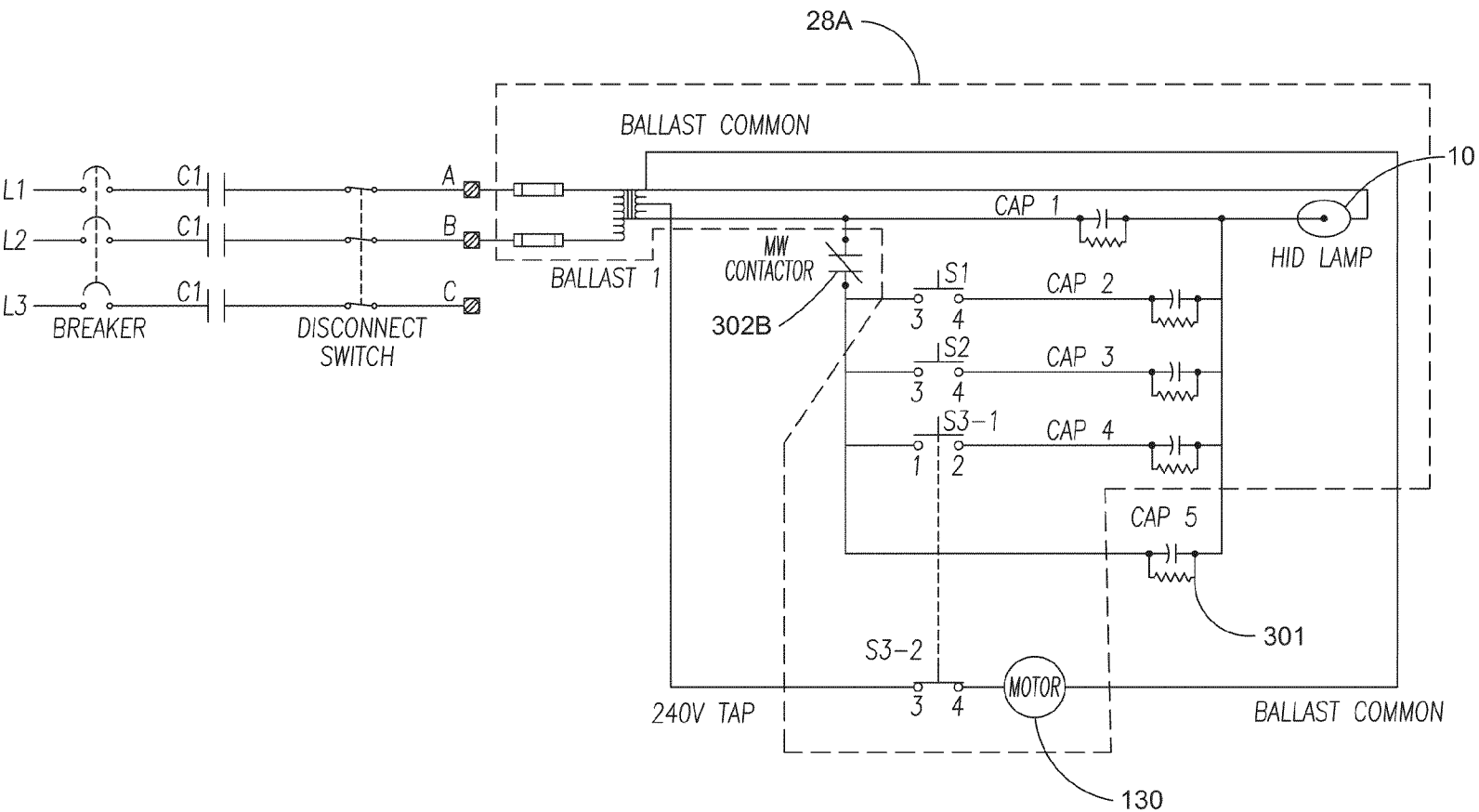
FIG. 15 is an alternative embodiment to that of FIG. 14 implementing lumen depreciation compensation for a lumen output level for the Smart Lamp™ system of FIG. 6 with an alternate lumen output level where lumen depreciation is uncompensated.
Figure 16:
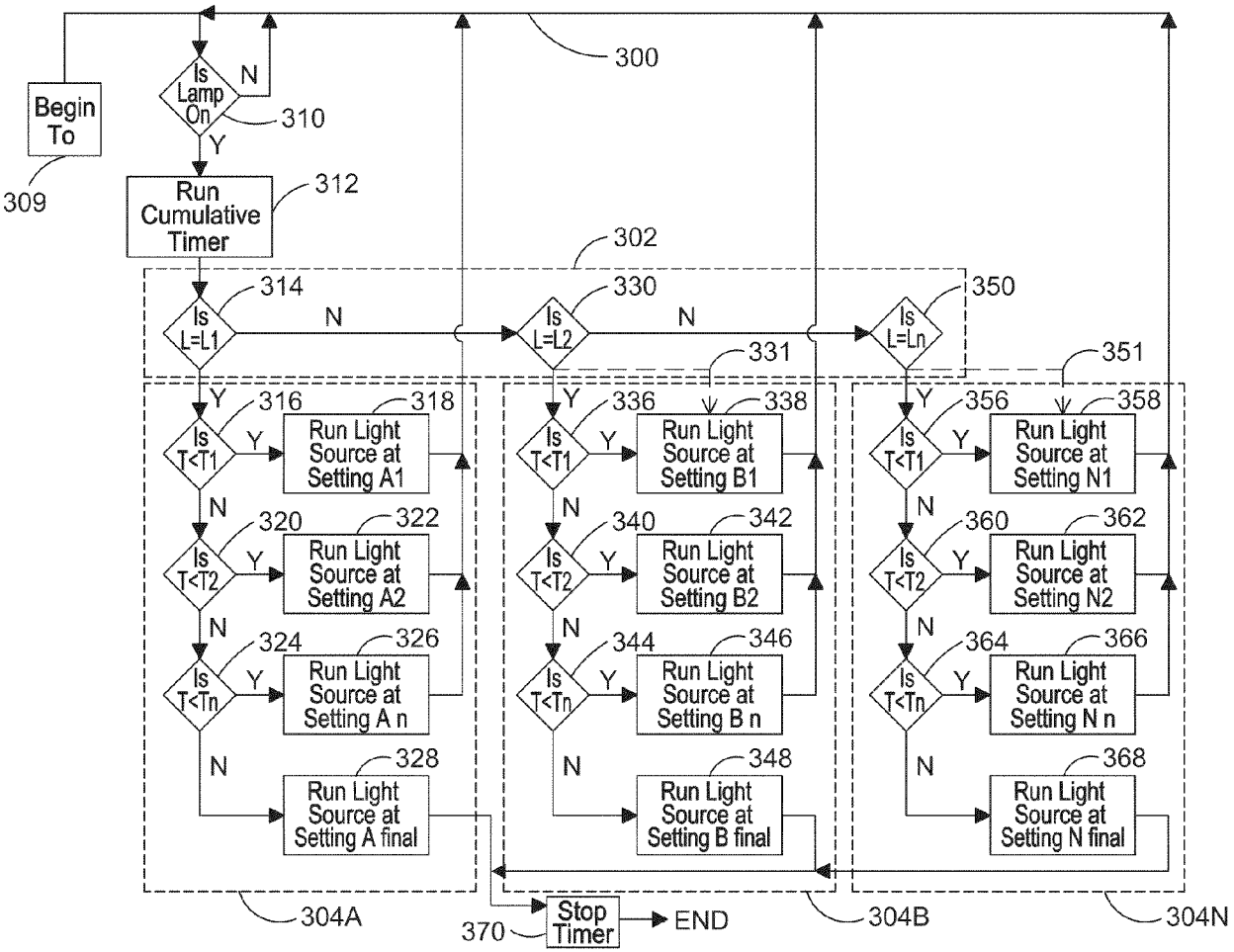

FIG. 16 is a block diagram of an exemplary method according to the embodiment of FIG. 14. It should be noted that for applications where lumen depreciation compensation is not required for an alternate lumen level, like the embodiment of FIG. 15, the method of FIG. 16 could be substantially utilized but, as illustrated in FIG. 16, use of LLD compensation in the alternative lumen output setting would not be used.

Figure 17:
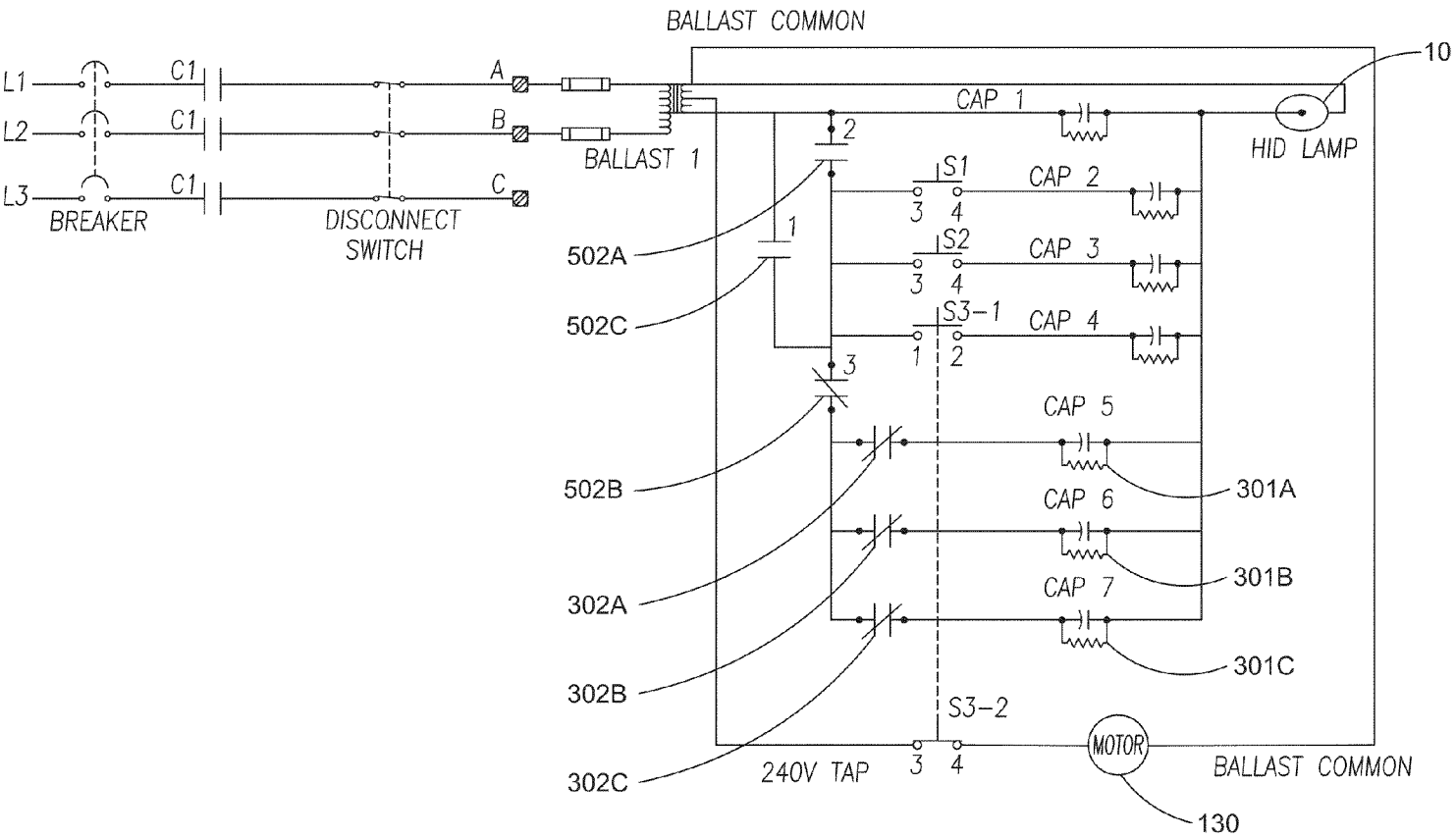

FIG. 17 is a circuit diagram of an exemplary embodiment which allows (a) selection of multiple levels of dimming and (b) selection whether or not LLD compensation is performed for any of the dimmed levels.

Figure 18:
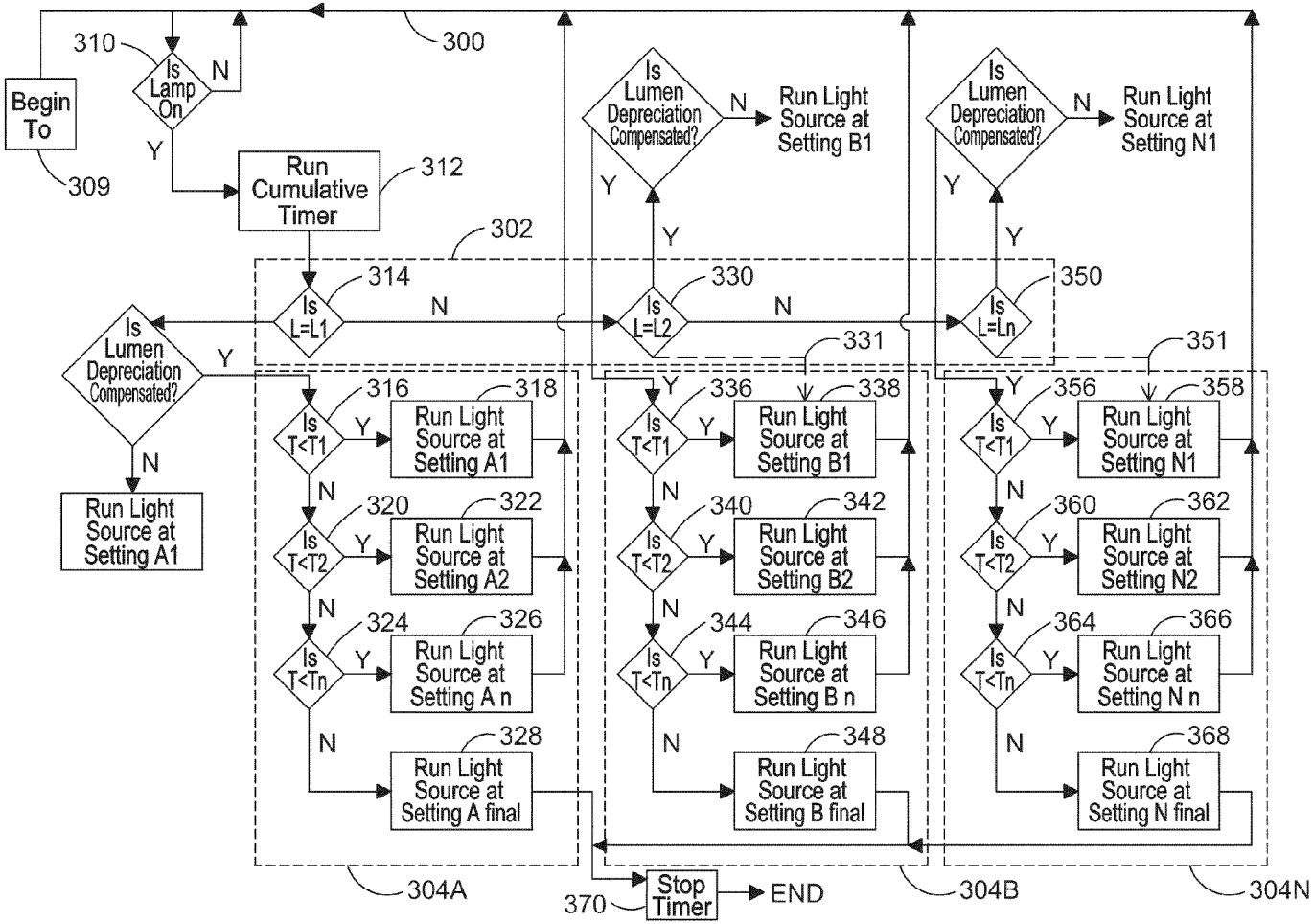

FIG. 18 is a flow chart similar to FIG. 16, but additionally illustrates the principle that LLD compensation can be selected or not for any of the possible dimmed levels.

IV. DETAILED DESCRIPTION OF EXEMPLARY EMBODIMENTS OF THE INVENTION

A. Overview

For a better understanding of the present invention, specific exemplary embodiments according to the present invention will be described in detail. These embodiments are by way of example and illustration only, and not by way of limitation. The invention is defined solely by the appended claims.

Frequent reference will be taken in this description to the drawings. Reference numerals and letters will be used to indicate certain parts or locations in the drawings. The same reference numerals or letters will be used to indicate the same parts and locations throughout the drawings, unless otherwise indicated.

B. Example 1

A first relatively simple example of the invention will be described in the context of a single HID light source which has an LLD (lumen depreciation) characteristic.

First, how much time the lamp is operating is tracked. This can be done in a number of ways.

Secondly, the lamp can be operated at an operating wattage below ROW, or "bumped down" from an initial operating wattage, for a certain period of operating time. The timing of and amount of bump down can vary. Generally, the magnitude of the bump down is preferred to be substantial enough that there is a material energy savings, at least over the bump down period. However, it is preferable it not be so low as to materially affect lamp performance (e.g. starting, efficacy, color, or lamp life) or reduce light output from the lamp too much. For MH lamps, the bump down would usually be more than 5% but less than 30%. A range of 10% to 20% would be likely. It is unlikely that bumps of less than 2% would be used, or bumps of more than 30%; either decreases (or, as will be discussed later, increases). Although there is usually a reduction in initial light output at the lower operating wattage, and lumen depreciation would proceed, a benefit of the bump down is the savings in energy. Operation of the lamp at the lower wattage uses less energy. Furthermore, indications are that some reduction of initial operating wattage (but not too much) may prolong lamp life. The timing of the bump down can vary from immediately to some time later. For example, there may be reasons to delay the bump down, such as providing ROW for initial starting of the lamp or ROW for an initial "break in" period (e.g. until it reaches "initial lumens" state).

Third, after the bump down period, operating wattage is then increased. The timing of a "bump up" of operating wattage can vary. One criteria could be with reference to the LLD curve of the lamp (e.g. FIG. 1). One candidate bump up time would be at the end of the initial rapid lumen depreciation of the lamp. Energy savings would be realized during the bump down period. But because light output drops so much during that time, by then "bumping up" or increasing operating wattage to the lamp, it also would increase or "bump up" light output from the lamp relative to the output when operated toward the end of the bump down level. This compensates somewhat for LLD light loss that occurred through the bump down period. The magnitude of the bump up can also vary. It can range from (a) complete restoration of operating wattage back to the level before the bump down to (b) a fraction thereof. Preferably, the bump up would move lamp light output back towards initial levels, but still be under the wattage before the bump down. Such a balance would achieve two advantages; continued energy savings and a restoration of some light level for at least a while (until LLD brings it down again). If the bump up is selected at the end of the initial rapid depreciation period, the light level usually depreciates at a slower rate afterward. Thus, even though the first bump up in operating wattage reduces the amount of energy savings, it will be a much longer time before LLD drops lamps light output level a similar amount to the initial rapid depreciation. Therefore, energy savings (though less in magnitude) can be enjoyed for a longer period of time.

This simple example shows how the method of the invention allows a creative way to compensate for LLD in a simple, practical way. It balances energy savings with maintenance of light output by making substantial, but not huge, alterations in operating wattage at a few selected times during the life of the lamp. Trade offs are made. For example, even though light level is not maintained continuously, it is restored to at or near initial levels for at least a while. And even though energy savings are not huge in the short term, over time they can become substantial.

In one aspect of the invention, selection of magnitude and timing of wattage changes is made with close reference to the LLD curve for the lamp involved. More than one bump up can be made. By periodically using modest bump ups, light output can repeatedly be restored while continuing to realize energy savings (even if those savings diminish over time). One important result is that the light output is continuously pushed back up towards initial output over the entire life of the lamp, even at the latter part of rated life when otherwise it would be approaching one-half initial output. And, energy savings would most likely be achieved.

As can be appreciated in this example, the number of bump ups can vary. Preferably, they would not exceed perhaps a hand full of times. And, as can be appreciated by those skilled in the art, the balancing of operating wattage versus light output can made case by case, based on the needs or desires of the light or the lighting application and based on the type of lamp and lumen depreciation curve for that lamp.

C. Example 2

A more specific example will now be described. It uses the general methodology described above with respect to Example 1. One example of such a light source is the HID lamp 10, like illustrated in FIG. 5, but any HID lamp exhibiting LLD is a candidate. Assume lamp 10 is a 1500 W MH lamp having a typical LLD characteristic such as a curve 2 of FIG. 1. The X-axis indicates cumulative operating hours of lamp 10 beginning at T0. The Y-axis indicates lumen output of lamp 10 as a percentage of initial lumens, beginning at 100% if the lamp is operated at rated operating wattage (ROW). Curve 2 shows how lumen output depreciates over time. Near the end of normal life of lamp 10, lumen output has degraded to around 50%. A first period of cumulative operating hours (e.g. 100-200 operating hours for a typical 1500 W MH lamp) results in approximately a 20% reduction in light output (see ref no. 4 in FIG. 1, from time T0 to T1). The slope 6 of curve 2 in period 4 is relatively steep. Curve 2 flattens out (its slope lessens, see reference numeral 8) over the remainder of operating life, but there is still a relatively constant loss of light output. The area 9 above curve 2 indicates how much light loss occurs for lamp 10 during it life, compared to its initial lumens.

With further reference to the flow chart 200 of FIG. 2, and the graphs of FIGS. 3 and 4, a method for compensating for some of the light loss of lamp 10 during its life will now be described.

1. Pre-Design Selections

Figure 1:
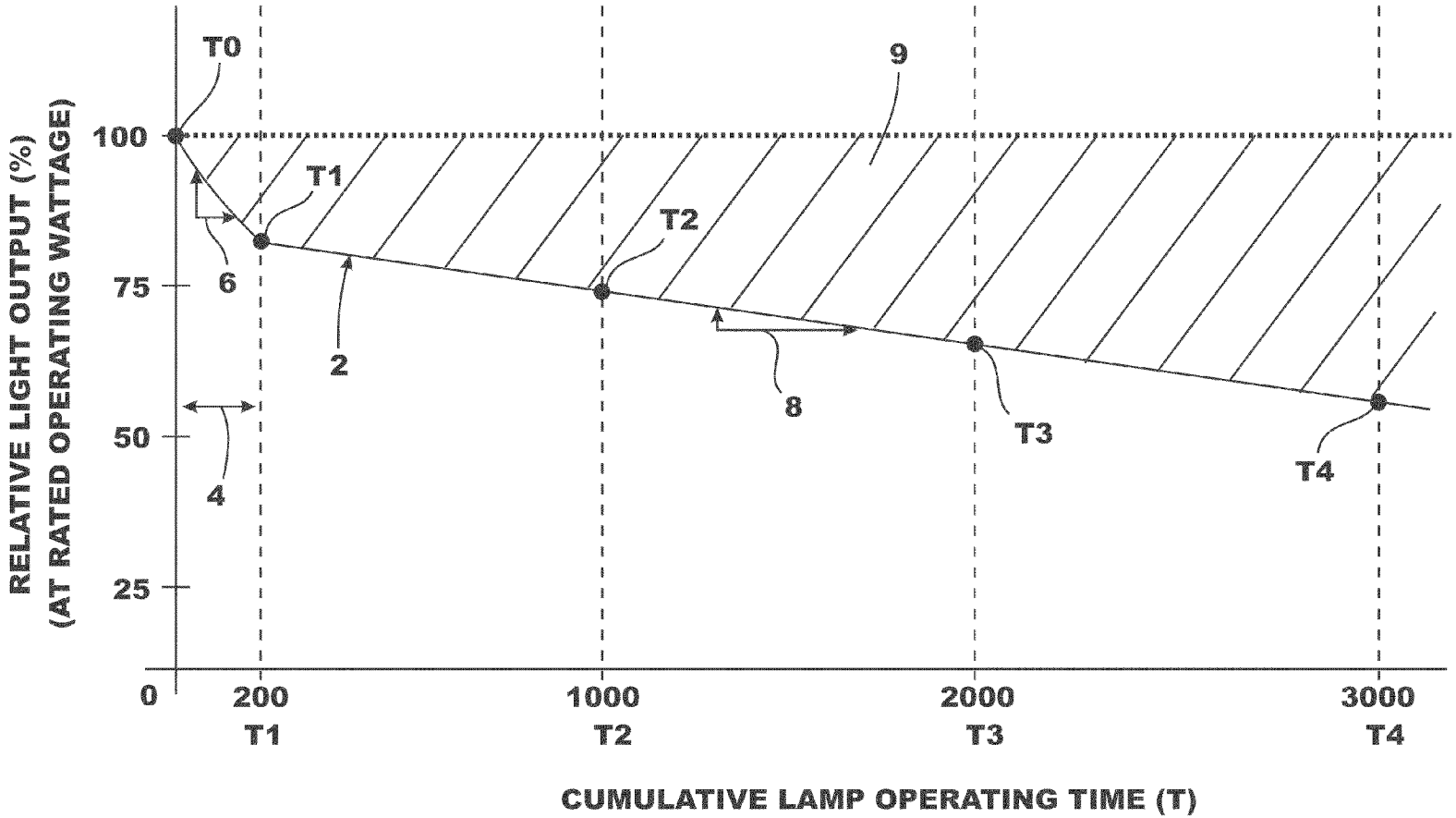
FIG. 1 is a diagram depicting lamp lumen depreciation or LLD for a 1500 W Metal Halide HID lamp, such as might be used with the lighting fixtures of FIG. 5, or for other lighting applications.

A goal is to provide a reasonable, practical, and cost-effective way to avoid suffering light loss of the magnitude indicated by FIG. 1 over the life of lamp. Curve 2 of FIG. 1 indicates the first rapid depreciation period 4 ends at around 200 hours of operating time for lamp 10. Assume expected life (T0-T4) is roughly 3000 hours. Assume LDF for the lamp is 0.7.

The design picks four points along curve 2 for wattage changes. First, a bump down in operating wattage at T0 is designed to save operating energy. A first bump up would occur at T1, the end of initial rapid depreciation (approx. 200 hours), to bring light output back up after that first rather steep loss. Because curve 2 then flattens out, the design picks two rather widely spaced apart times T2 (1000) hours) and T3 (2000 hours) for further increases.

Figure 3:
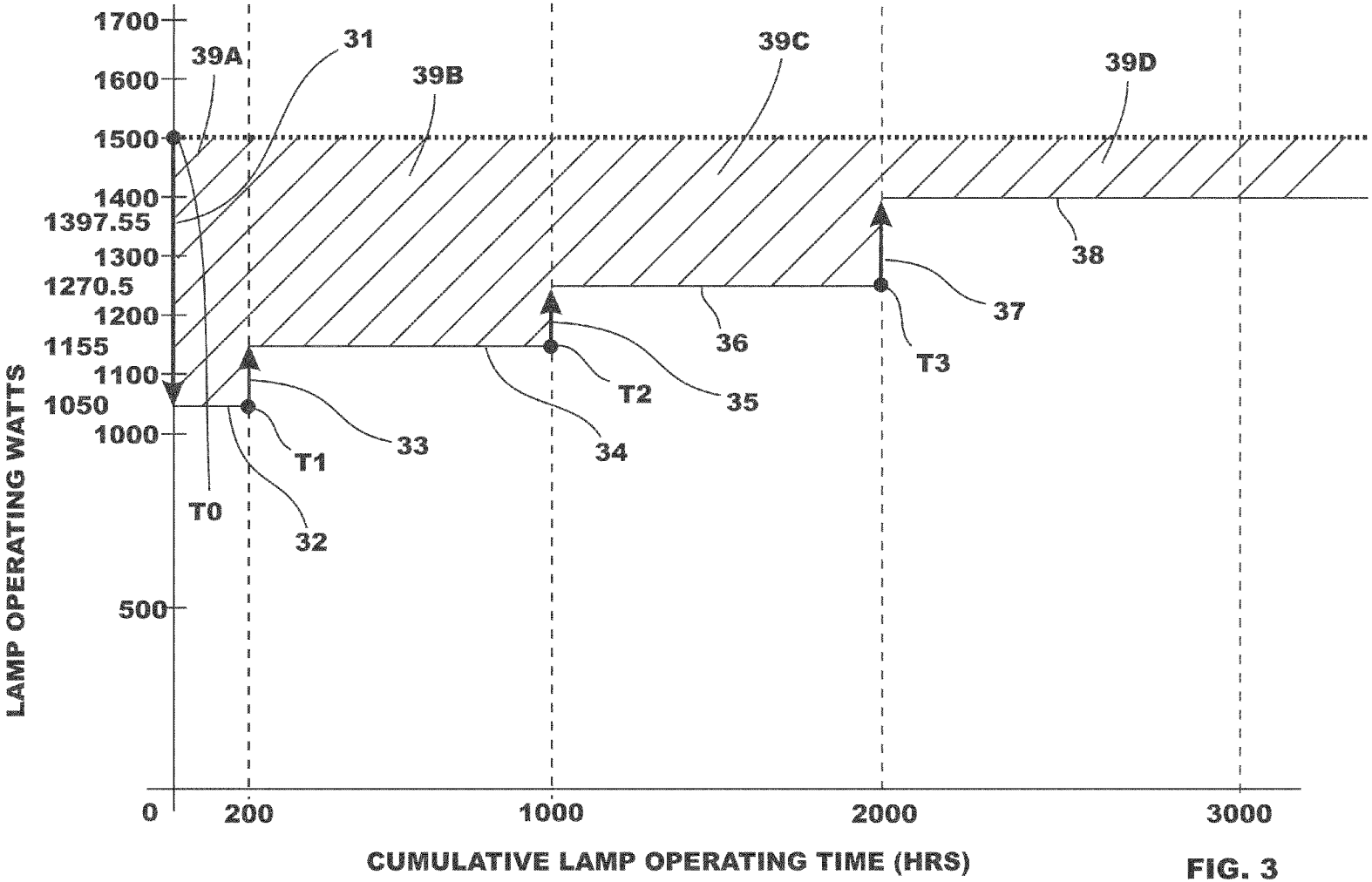
FIG. 3 is a graph depicting operating wattage using the method of FIG. 2.

The magnitude of the wattage changes is shown at FIG. 3. This design correlates initial bumped down wattage to LDF for the lamp; i.e. ROW*LDF=1500 W*0.7=1050 W. Thus, this bump down (ref. no. 31) of 450 W operating at 1500 W for that first period (T0-T1) and operating the lamp at 1050 W (ref. no. 32) for a first period of time represents a planned significant energy savings (see area indicated at ref no. 39A). Because it is based on the LDF for the lamp, it is correlated with light loss predicted for the lamp over its life. Using this equation attempts to decrease light output for energy savings, while at the same time still providing a satisfactory amount of light for the application.

The design selects the length of the bump down period to extend until approximately the end of the first rapid depreciation period (until time T1, or approximately 200 hours of operation). At T1, the design bumps up wattage, calculated to basically restore the lamp light level to at or near its initial level. In this example, this is found to require about a 10% bump (see ref no. 33, e.g. 105 W). Operating wattage of approximately 1155 W occurs (ref no. 34) between time T1 (200 hours cumulative operating time for the lamp) and T2 (1000 hours cumulative operating time for the lamp). Additional anticipated energy savings during this time is indicated at FIG. 3, ref no. 39B.

Then, similarly, the design has two more bump ups (ref. nos. 35 and 37) at times T2 and T3. Between T2 and T3 the approximately 10% bump up (ref. no 36, e.g. to approx. 1270 W) is designed to realize further energy savings (ref. no. 39C), as does the approximately 10% bump up after T3 (ref. no 36, e.g. to approx. 1397 W and ref. no. 39D). All wattage bump ups are still below the 1500 ROW. Thus energy savings over operating the lamp at 1500 W are planned and realized throughout its operating life.

2. Timing Cumulative Lamp Operation.

Referring now to the flow chart of FIG. 2, the method 200, according to an aspect of the second example of the invention, will be described in detail, Method 200 begins (FIG. 2, step 209) by initializing the value of cumulative operating time T of the lamp to T0 (e.g. setting the value of T0 to zero). Cumulative "on" time of lamp 10 is tracked. This can be done in a number of ways, but the example here simply runs a cumulative timer (step 212) at all times lamp 10 is on (step 210). If the lamp is not on, nothing happens and the timer is not incremented (the value T is not increased).

3. Reduce Initial Operating Wattage.

During operating time T between T0 and T1, operating wattage of lamp 10 is reduced or dropped below its rated operating wattage. This can be done in a number of ways. Specific examples will be discussed later.

In step 214, this reduction or bump down is expressed as the "ROW", the lamp manufacturer's rated operating wattage, minus "L", a variable. It is generally indicated to drop initial operating wattage as low as possible to save as much energy as possible, but not too far so that it materially adversely affects the lamp, its efficacy, or its operation. For example, operation too far under ROW is believed to affect ability to start and maintain these types of lamps, as well as some operating characteristics of the lamp. One technique is to limit the initial drop in wattage to no more than the rated operating wattage times the lumen depreciation factor for the particular lamp, or ROW*LDF. In the case of 1500 W MH lamps, LDF tends to be around 0.7 to 0.8. Thus, using this rule would result in the variable L being on the order of 20% to 30% of ROW (rated operating wattage of the lamp). Thus, L might be around 300 to 450 W in such an example; meaning an initial operating wattage of around 1050 to 1200 W for lamp 10 (step 216).

One way to determine the initial reduction offset is by estimating how much it can be reduced and still meet a goal of keeping minimum specified light output and other lighting requirements during initial rapid depreciation period 4 between times T0 and T1. As previously mentioned, some lamps lose as much as 20% light output in first 100-200 hours or so. Based on the previous assumption that lamp 10 produces excess light initially, the initial decrease or offset of operating wattage could be no more than to maintain a light output reasonably close to desired light output for the application. Selection of the amount of bump down should generally be not so much that it materially affects lamp starts, but preferably gives a substantial energy savings. It appears preferable to not run the lamp too low, because the lamp can suffer too much loss of efficiency. It is therefore recommended to start with multiplier that is based on LDF (e.g. between 0.7 to 0.8 or 70% to 80% of normal or mean lumens). For higher powered lamps, 0.7 may be too much because of too much efficiency loss.

As indicated by the cross-hatched area 39A in FIG. 3, operation at 1050 W would result in a savings of energy as compared with operating at 1500 W for the time between T0 and T1. However, as indicated at FIG. 4, because of its inherent LLD characteristic, lamp 10 will still suffer lumen depreciation (see ref. no. 42, FIG. 4).

4. Increase Operating Wattage.

However, method 200 seeks to compensate for this LLD in the following fashion. At selected time T1, as kept track of by the timer, the operating wattage of lamp 10 will be increased. When the timer indicates T1 has been reached (T=T1, step 214, FIG. 2), method 200 adds back an amount M of operating wattage to the previously decreased amount (step 220, FIG. 2).

The amount of increase can vary. In this example, approximately 10% is added back, so at T1 operating wattage is bumped approximately 105 W (see ref no. 33, FIG. 3) to approximately 1155 W. Note how the length of time between T1 and T2 is much longer than between T0 and T1. This corresponds with the LLD curve 2 for lamp 10; lumen depreciation occurs at a much slower rate after T1.

Figure 4:
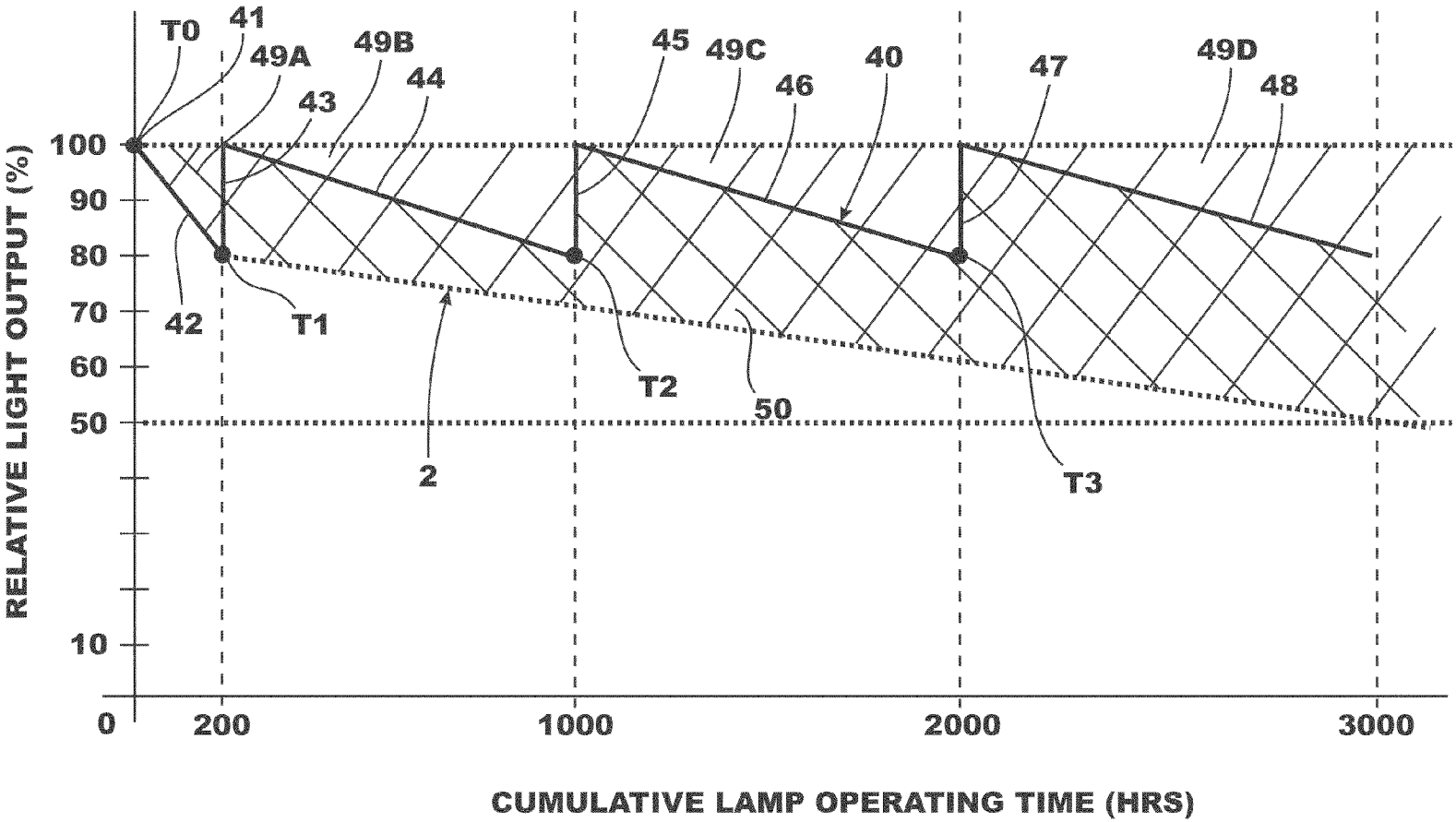
FIG. 4 is a graph depicting lumen output of the lamp as a function of time using the method of FIG. 2.

FIG. 4 shows that instead of allowing LLD to cause light output to continue to drop, method 200 restores light level back to at or near where it was originally. FIG. 3 shows at hatching 39B that, for the extended period T1 to T2, addition energy is saved as compared to running the lamp at 1500 W. However, even though energy is added to lamp 10 by this increase or bump, and it raises the light output back to around the 100% mark (see ref no. 43, FIG. 4), this restoration of light output to the desired level does not last. Again, LLD would cause light output to decline (see ref. no. 44, FIG. 4) during the period T1-T2.

5. Increase Operating Wattage Again, if Desired.

Method 200, however, simply repeats the compensation procedure just described. At time T2 (when T=T2, step 218, FIG. 2), an additional wattage increase (variable N) is made (see bump 35 to wattage 36 in FIG. 3). In FIG. 3, this is another 10% raise to approximately 1270 W (step 224, FIG. 2), but still saves energy compared to operating at 1500 W. Light output would be restored, at least initially (ref. no. 45, FIG. 4). Flow chart 200 of FIG. 2 shows this bump up by the equation [(ROW−L)+(M+N)]. In this example, M and N are the two 10% increases.

Figure 2:
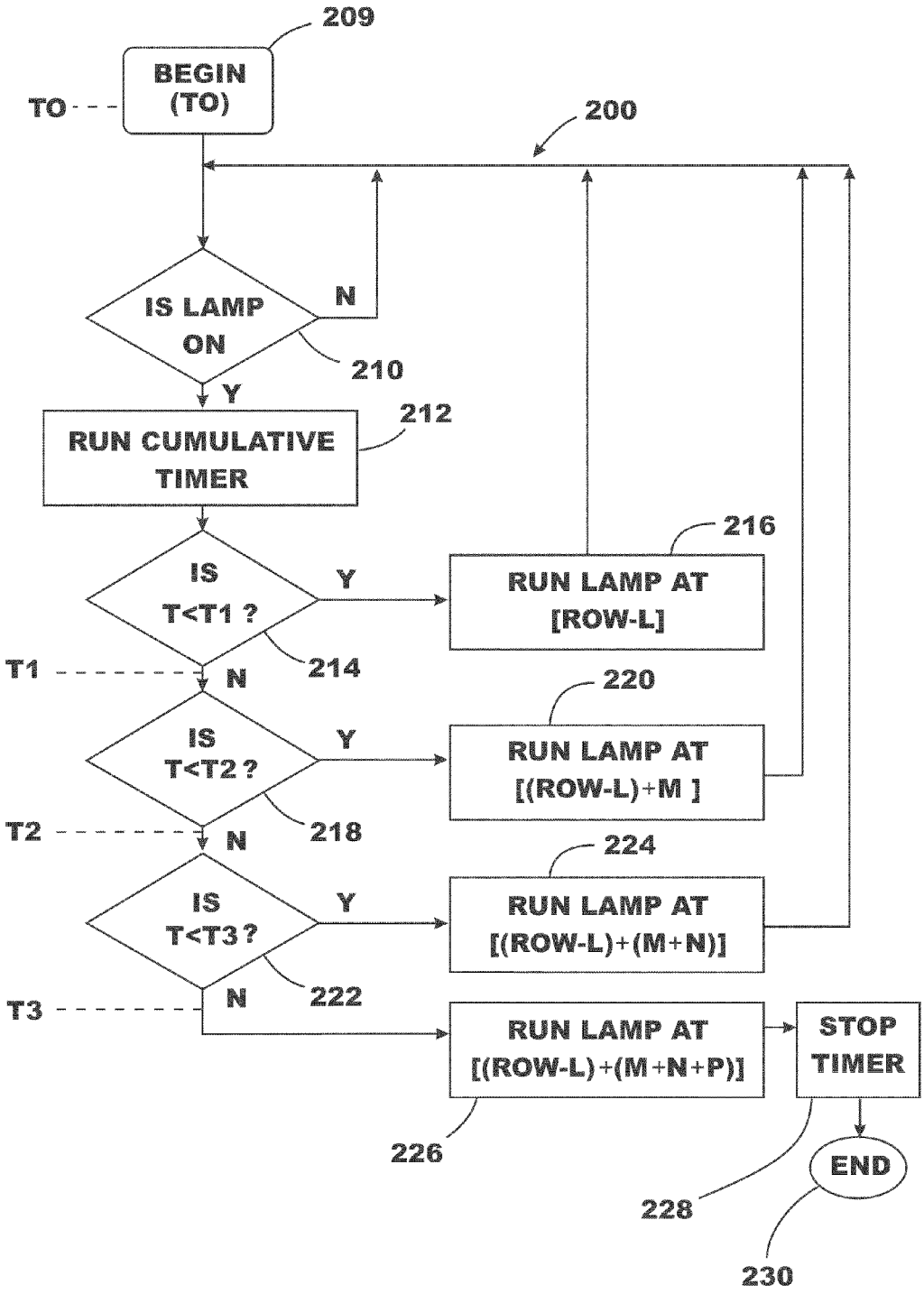
FIG. 2 is flow chart of a generalized method to compensate for LLD according to an exemplary embodiment of the present invention.

This compensation could be repeated a third time at T3 (steps 222 and 226, FIG. 2). In this example, however, the jump of another approximately 127 W (ref no. 37, FIG. 3) to approximately 1397 W is the last increase. The additional added wattage (variable P of step 226) in this example is, again, a 10% increase from the immediately preceding wattage.

Once the third and last increase or bump up as been made, the timer can be turned off (step 228, FIG. 2) and the method essentially is completed. Further timing is not needed because the last operating wattage is used until the lamp either fails or is replaced.

If a new lamp is installed for the same application, a similar lamp with similar LLD can be replaced and the timer is reset to zero to begin a new tracking of cumulative operation time for the new lamp to allow the method to provide the pre-selected wattage changes at the pre-selected times.

Thus, under the method of flow chart 200, operation time of lamp 10 is monitored and accumulated. An initial decrease of operating wattage from ROW is followed by three increases back towards ROW. It is to be understood, however, that variations in the method are possible. For example, one bump up in power after an initial "below ROW" operation may be all that is selected. Or, further power bump-ups, over and above the three indicated at FIG. 2, could be pre-designed at selected times and amounts during predicted operational life of lamp 10.

FIG. 3 depicts how actual operating wattage would be applied to lamp 10 over a substantial part of its operating life if the method of FIG. 2 is used; e.g. a decrease from ROW (ref. no. 31) to 1150 W (ref. No. 32) for first 200 hours, bump up (ref. no. 33) to 1300 W (ref. no. 34) for next 800 hours, bump up (ref. no. 35) to 1450 W (ref. no. 36) for next 1000 hours, and bump up (ref. no. 37) to 1500 W (ref. no. 38—back to or near ROW) for remainder of lamp operation. Because of the much shallower slope of curve 2 after the initial rapid depreciation period (first 200 hours), the spacing between times of power bump ups (ref nos. 33, 35, 37) can be substantially increased. This means less bump ups to restore light level, but also means increased energy savings. The hatched area 39 under the 1500 ROW line indicates energy saved by method 200 as compared to operating lamp 10 continuously at ROW of 1500 W. Even though the savings may be relatively small over small periods in time (e.g. cents per hour), cumulatively over thousands of hours it can add up (e.g. $40-50). And, of course, savings are amplified by the number of fixtures per installation. If there are one hundred fixtures, this can mean on the order of $5,000 dollars in energy savings over the normal operating life of the lamps.

Thus, using method 200, nearer the end of operational life, operating wattage may be brought up to around 1,500 watts. Thus, for at least most of the preceding life, the amount of electricity used is less than used when operating at the normal 1,500 watts ROW. However, lumen output is periodically restored to at or near minimum desired level. Lumen depreciation is thus combated. Therefore both benefits of less initial electricity used and rough maintenance of desired light level are accomplished.

Optionally, the last bump up of wattage might be selected so that operating wattage exceeds 1500 W (e.g. values from just above 1500 W up to 1650 W or maybe somewhat higher). This might be needed to restore light output of lamp 10 to approximately the initial desired output. In other words, late in lamp life, it might take more than ROW 1500 W to drive the lamp to produce an output approximately at its initial lumens. This "overdriving" may result in a little extra cost of energy (as compared to operating it at 1500 W), but there likely was a net energy savings over the early periods, and the benefit of keeping light output near the original output is achieved.

According to preliminary indications, operating an HID lamp of this type initially at a lower wattage may prolong its life. This may be another advantage of method 200.

Of course, different methodologies to that of flowchart 200 could be used with the invention. For example, wattage could be literally raised directly in correspondence with lumen depreciation with appropriate technology (e.g. every 10 hours raise wattage a bit). However, this may be impractical or too costly. It is presently envisioned to have limited number changes to increase wattage; perhaps no more than 2, 3, or 4 changes over the lifetime of the lamp. Compared to attempts to continuously monitor operating wattage and adjust the same (which can require sensors, interfaces with the lighting system, and other components), this would allow low cost electrical or electronic components to be used to change the wattage.

Also, of course, the magnitude and timing of wattage changes could be adjusted for different lumen depreciation curves for different lamps. Based on current understandings and beliefs, the following preferences are believed indicated for the method of FIG. 2:

a. Monitoring of lumen depreciation. No sensors or special lumen depreciation monitors are required.
b. Timing of wattage changes. Selection of times for wattage changes are normally based on the lumen maintenance curve for the lamp. Gross but simple changes are preferred. In other words, preferably pick best time to bump, but bump only a few times.
c. Magnitude of wattage changes relative to one another. Simplicity is generally preferable. Therefore wattage changes based on practicalities such as simplest, cheapest way to alter wattage are preferred. However, bumps do not have to be linear in magnitude.
d. Magnitude of initial wattage bump down. As discussed earlier, preferably the bump down would not materially affect lamp performance or starting, and would achieve reasonable light level for its use.
e. Timing of first bump up. The lower the initial decreased operating wattage, the longer the time until a first bump up of wattage.
f. Magnitude of first bump up. Determine first increase by how much lumen depreciation the lamp will likely experience for the initial operation period. Increase amount which will keep lumen output reasonably close to goal.
g. Magnitude of subsequent bump ups. Determine subsequent increases, if any, the same way. Rule usually involves having a priori knowledge of lumen depreciation curve for the particular lamp, or good estimate.
h. Magnitude of end of life wattage. It may be advantageous to overdrive (operate above ROW) the lamp towards end of life. It is less risky because lamp is closer to failure anyways. If overdrive towards end of lamp life, do not need to start out at too low initial wattage. It is believed preferable to avoid bump up or overdrive high enough to effect lamp life (e.g. 1750 W probably highest for 1500 W ROW lamp).
i. Range of wattage changes. Therefore, it seems preferably to have a relatively narrow range between lowest wattage and highest wattage; do not go so low as to affect efficacy, efficiency, or starting of lamp; do not go too high to effect lamp life. This goal should also be combined with preferable goal to keep lumen output within +/−10% of desired output.
j. Number of wattage changes. Number of increases is primarily based on practicalities. It adds cost and complexity the more switching is needed. Lumen depreciation rate slows dramatically after initial period. Therefore, balance is believed to be one increase at end of initial rapid depreciation period, and then two or three thereafter, at much larger intervals. Initial rapid depreciation can account for up to 10-20% loss. Additional 30-60% is possible over remaining lamp life.
k. Replacement of lamp. In conventional systems, many times must replace before operating life is done because simply does not put out enough to be effective. Here, run until burns out or to nearer end of normal life.

In this example, it is assumed that the light loss during the initial T0-T1 period is accepted, even though it would result in a 20% loss by the end of the period. However, alternatively, lamp 10 can be originally selected, by considering its initial lumens output and its LLD (including its LDF), such that it will provide more than enough initial lumens light output for the application, and roughly sufficient light output lumens at the end of the rapid LLD period (time T1).

D. Example 3

Figure 5:
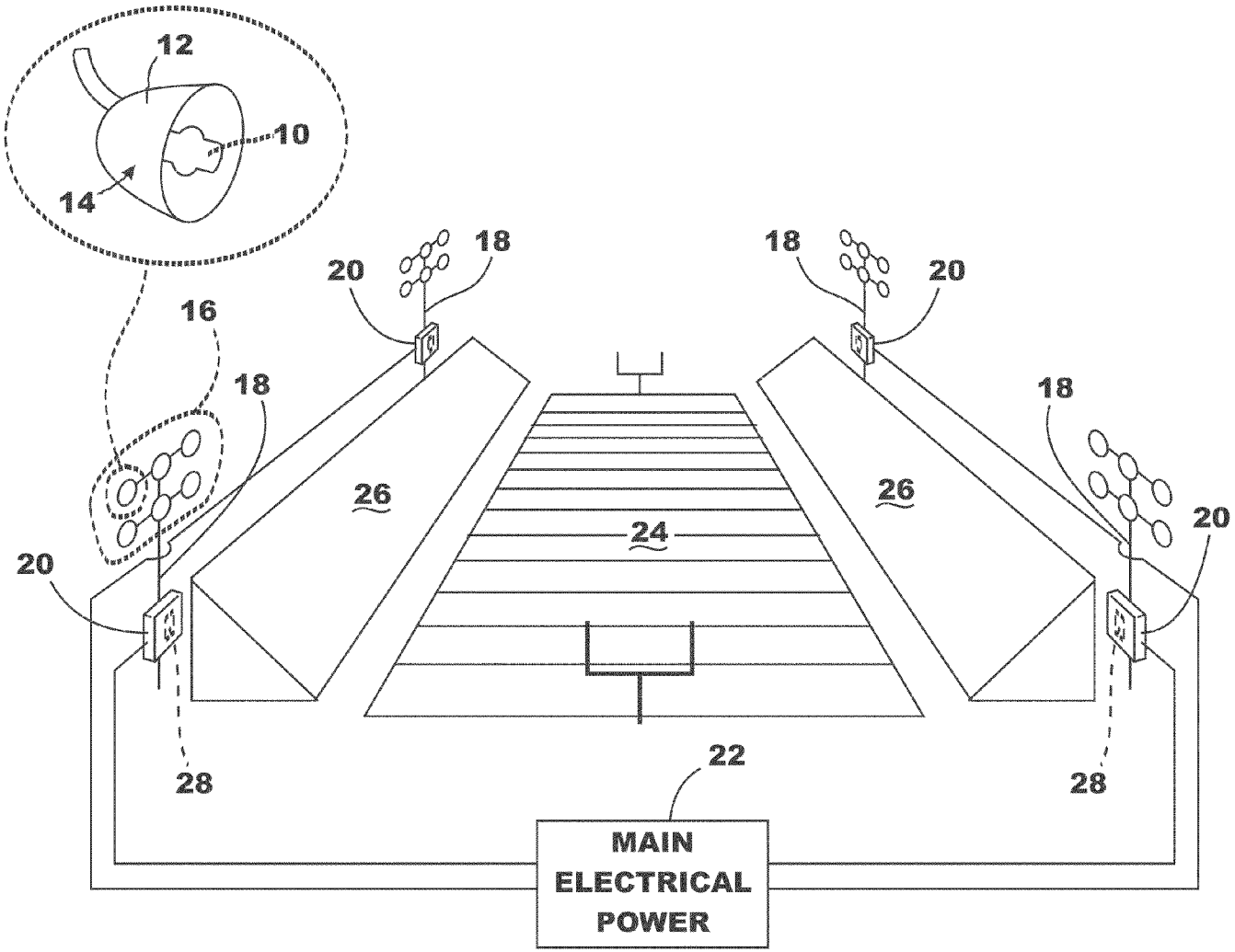
FIG. 5 is a diagrammatical simplified illustration of a sports lighting installation including a plurality of sets of HID lighting fixtures, each set elevated on a pole and being supplied with electrical power from a main power source, also schematically indicating inclusion of an LLD compensation circuit for each sets of lights according to one exemplary embodiment of the invention.

Another example of methodology according to one exemplary aspect of the invention will be described in the context of wide-area lighting for sports. One example of such type of lighting installation and system is illustrated in FIG. 5. A plurality of luminaries 14, each including a 1500 W MH lamp 10 of the same type and manufacturer, are elevated in sets 16 on poles 18. Electrical power is supplied to each lamp 10 from main line source 22 via a ballast for each lamp 10 in its respective ballast box 20.

By referring again to the flow chart of FIG. 2, a method of compensating for lumen depreciation (LLD) that will occur for lamps 10 during operational life for the group of lamps 10 of FIG. 5 will be described.

In this instance, lamps 10 are selected in conventional fashion for sports lighting. Computer programs are well known and available in the art to design a lighting system for field 24 according to specifications for lighting of field, which include a minimum light level at and above field 24. Other methods are possible. From manufacturer information or empirical testing and measurement, initial light output (sometimes defined as output, in lumens, after 100 hours of seasoning; also sometimes referred to as initial lumens) is determined.

The characteristic lumen depreciation (LLD) for the type of lamps 10 used is determined. This can be determined from information from the lamp manufacturer. It can also be empirically derived. From this information a lumen depreciation curve like FIG. 1 can be obtained or derived. In this example, the assumption is made that the curve is generally representative for all lamps 10, as they are similar. The LDF (lumen depreciation factor) can be used to select the lamps.

As discussed with method 200 of FIG. 2, knowledge of initial lumens of lamps 10, the LLD curve, and specified minimum light levels for all lamps 10 relative to field 24 allows reverse engineering to determine an approximation of how much less electrical energy can be supplied to lamps 10 (for a given number of fixtures and their positions relative to the field) below that needed to run at rated operating wattage to illuminate the field at the specified level.

With this knowledge, using well-known design methods, the designer of the lighting system can select the number and position of fixtures for the application to have sufficient cumulative light for the field, factoring in an initial drop in operating wattage for lamps, based on the offset between initial lumens and mean lumens predicted for the lamp to approximate the light output from each lamp 10 needed initially to create the specified light level for field 24.

Table 1 below indicates one regimen that could be selected according to the following design criteria:

1. Goal—maintain 100 foot-candles +/−10% from each 1500 W lamp up to end of normal life of lamp (3000-4000 hours).
2. Start lamp at 1500 watts (may need cold start regimen).
3. Operate lamp initially at 1250 W, instead of 1500 W (about 15% drop from ROW).
4. Using timer, at time T1, estimated end of initial rapid depreciation time (e.g. 200 hours), kick in additional electrical energy (e.g. approximate 5% increase or 1320 W).
5. Using timer, at time T2, estimated point of drop of additional 10% light output (e.g. 1200 hours), kick in addition electrical energy (e.g. approximately 8% or 1440 W).
6. Using timer, at time T3, estimated end of another 10% lumen drop, kick in more energy (e.g. at 2200 hours go up approximately 8% to 1560 W).

TABLE 1

| Operating Hours (T) | Actual Operating Watts |
|---|---|
| 0 | 1260 |
| 200 | 1320 |
| 1200 | 1440 |
| 2200 | 1560 |

Using the regimen of Table 1, energy savings similar to FIG. 3 would be predicted, except for the operating time after T3. After T3 the lamp is actually overdriven (operated at 1560 W). Therefore, there would be no energy savings, but actually an increase in energy use. The increase would be relatively slight (60 W over rated wattage). But, importantly, even at this late part of lamp life, light output would be restored for a while and, by rated end of lamp life, light output would be substantially higher than with no compensation.

With the regimen of Table 1, a similar light output to that depicted in FIG. 4 would be created. Note that FIG. 4 super imposes the lumen depreciation curve 2 of FIG. 1 onto the graph to illustrate how initial power and subsequent bump-ups in power compensate for lumen depreciation of lamps 10. Although the compensation method of this example does allow light loss to occur between points TO, T1, T2, and T3 (and after point T3) (see areas in FIG. 4 indicated by ref nos. 49A-D), it avoids the substantial light loss between curve 40 and curve 2 (see area marked with ref no. 50 in FIG. 4). Because of the much shallower slope of curve 2 after the initial rapid depreciation period, the spacing between times of power bump ups can be substantially increased. This means less bump ups to restore light level, but also means increased energy savings (see FIG. 3). Even though the savings may be slight over small periods (e.g. $0.07 per kW hour), cumulatively over thousands of hours it can add up (e.g. $40-50 a lamp), and, of course, is amplified by the number of fixtures per installation. If there are one hundred fixtures, this can mean on the order of $5,000 dollars in energy savings.

1. Apparatus

Implementation of the above described LLD compensation method can take many forms and embodiments. One specific exemplary implementation of the above LLD compensation method into the lighting system of FIG. 5 could be as follows. Each ballast box includes conventional operating components for the lighting fixtures on its respective pole 18, including standard lead-peak ballasts for each lamp 10. In this example, a circuit 28 is added to each ballast box 20. Each circuit can perform LLD compensation on a plurality of lamps 10 (e.g. six lamps).

a) Lamp

Lamps 10 are Philips Electric 1500 W MH lamps (product #MH 1500U).

b) Fixture

Conventional aluminum bowl-shaped luminaire with mounting mogul.

c) Power Source

Conventional line current (480V to disconnect switch).

d) Power to Lamp

Power is provided to each lamp 10 through a lead-peak ballast (Venture Model 79-18-16410-2). Under state of the art practices, 1500 watts operating power is normally provided to each lamp 10. However, as explained below, altered power levels are provided.

e) Selection of Power Levels

Figure 6:
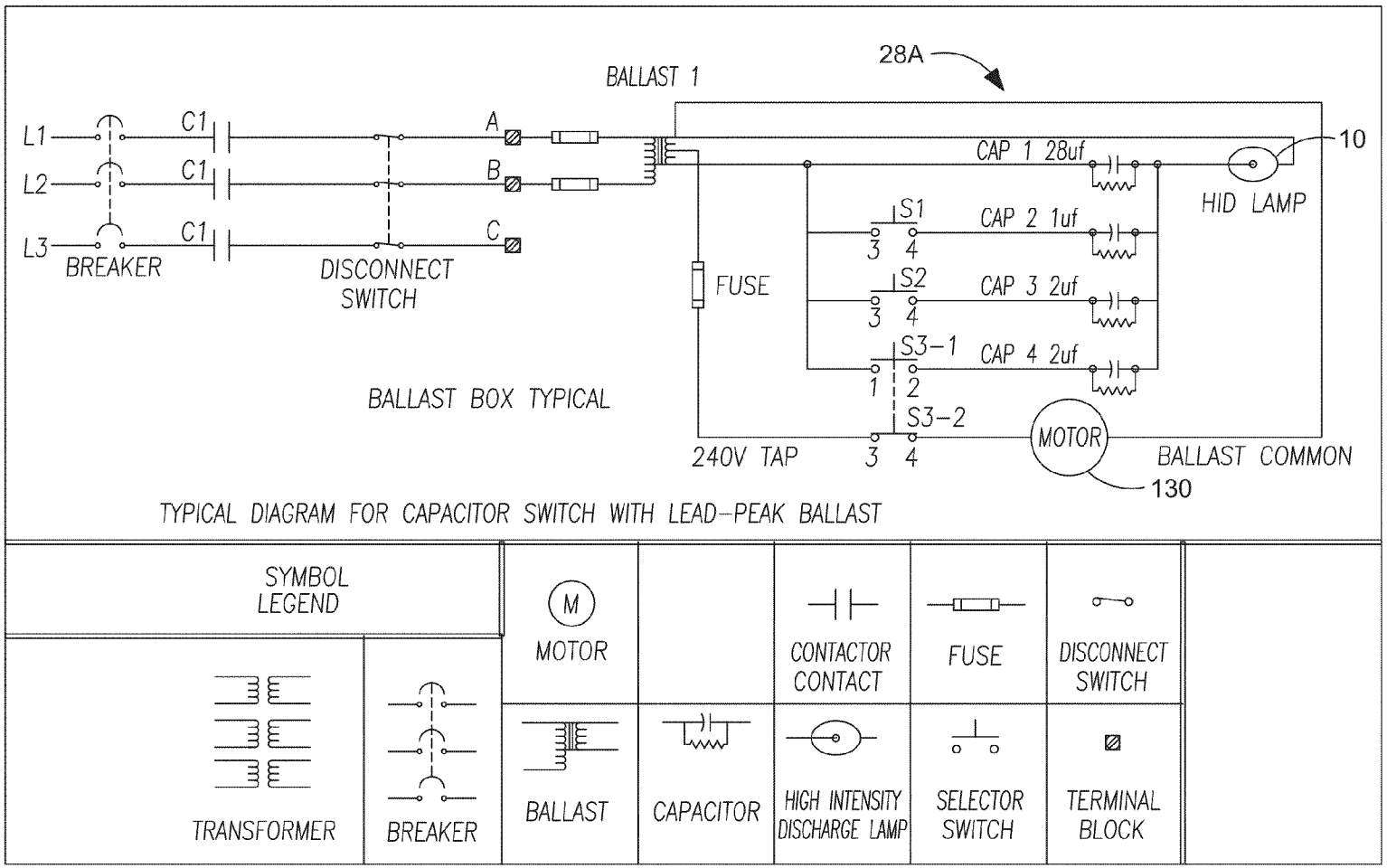
FIG. 6 is an electrical schematic of sub-circuit for providing different wattage levels at preselected times to a lamp in the LLD compensation circuit of FIG. 5.

One way to provide four different operating power levels is by circuit 28A of FIG. 6. Power (480V) from line source L1, L2 is supplied to connection points A and B in each ballast box 20 for each pole 18 through contactor contact C1 and a disconnect switch (allowing disconnect of power at each pole 18; e.g. for maintenance of just the lights on that pole). One or more lamp circuits can be attached to points A and B (e.g. up to six lamp circuits). FIG. 6 illustrates one lamp circuit.

Each lamp circuit has a conventional lamp ballast (Ballast 1) and lamp 10. The 480V is available to the lamp circuit, through fuses for protection of the subsequent circuitry, to the primary coil of conventional Ballast 1.

Four parallel paths exist between the secondary of ballast 1 and lamp 10. Each path includes a capacitor (Cap 1, 2, 3, or 4) and a switch.

A motor 130 is powered through a 240V, 20 W tap on Ballast 1. Motor 1 therefore only operates when power is supplied to lamp 10. Motor 130, its cams, and the gears in between, are selected and configured so that the cams rotate 360 degrees or one revolution no more than once over the rated life of the lamp. In this example the cams are set to rotate once every 4000 hours of motor operation. Therefore, the motor/cam combination (sometimes called a cam timer) essentially keeps track of cumulative operating time of lamp 10. By appropriate configuration of raised areas or cut-outs on the perimeter of the cams, switches can be closed or opened at appropriate times during the 4000 hours.

Motor 130 turns timing cams (see Cams 1-6, FIGS. 10 and 11) that operate contactors (Contactors 1-6, FIGS. 10 and 11) that comprise the switches S1, S2, S3-1 and S3-2 of FIG. 6. The switches determine how much capacitance is switched into lamp 10 at any given time.

If following the method of FIG. 2, at T0, cams associated with motor 130 are reset. Switches S1, S2, and S3-1 are normally open and S3-2 normally closed. Motor 130 and its cams are configured so that during T0-T1 the switches stay in those positions. This means only Cap 1 (28 μf) is in-line with lamp 10. The capacitance of Cap 1 is selected to operate lamp 10 below rated operating wattage of 1500 W, e.g. at the value of Table 1, that is, 1260 W.

When the motor has operated the equivalent of 200 hours (until T1), a cam closes S1. This adds in the 1 μf of Cap 2 in parallel with Cap 1, which raises operating wattage of lamp 10 to 1320 W (approx. 5% raise).

When motor has operated the equivalent of an additional 1000 hours (T2—1200 hours total), a cam closes switch S2 to further add Cap 3 (2 μf) in parallel with Caps 1 and 2. This raises operating wattage of lamp 10 to 1440 W (approx. 8% raise).

Finally, when motor has operated an additional 1000 hours (T3—2200 hours total), a cam closes switch S3-1 to further add Cap 4 (2 μf) in parallel with Caps 1-3, to raise operating wattage of lamp 10 to 1560 (approx. 8% raise). Switches S3-1 and S3-2 act in tandem, but oppositely. Therefore, when Cap 4 is added (the last increase), there is no need for further operation of the motor, so switch S3-2 breaks the current to the motor and it stops. Further timing is not needed because the regimen of Table 1 has been designed to make only three wattage bumps. However, Caps 1-4 all remain connected to lamp 10. The remaining further operation of lamp 10 in its operating life after the last bump will be at the operating wattage created by line current and Caps 1-4.

If lamp 10 fails and is replaced (or otherwise is replaced), the switches can be reset to original normal positions, as can the cams and motor. The circuit is ready to repeat the method for the new lamp.

The circuit of FIG. 6 therefore adds some components to a conventional lamp circuit. However, they are minimal and relatively inexpensive. Cam timers are only several dollars each. One cam timer can be used for a plurality of lamps 10; here six. The capacitors and associated wiring only add a few dollars of cost.

But, importantly, the apparatus to switch in the capacitance operates off of the line voltage needed for the lamps. No separate power source or battery is needed. Also, the electromechanical cam timer is highly reliable and long-lasting. The motor rotates at a fraction of a revolution per hour (rph). The motor is the timer. No special timing device is needed. Also, the design is flexible as the levels of lamp operating wattage can be selected by merely selecting the capacitance of the capacitors. The changes in operating wattage do not have to be equal in magnitude. Most ballast boxes have ample room for these components.

f) Timer

As mentioned, FIGS. 10-13 illustrate an exemplary cam timer assembly 100 that can be used for the circuit of FIG. 6.

By a typical arrangement, a gear motor rotates cams which operate switches at appropriate times to add the capacitors discussed above. It is relatively low cost, compact, durable, and reliable. It runs off of the electrical power for the lamp, so no extra power source or battery is needed.

Figure 10:
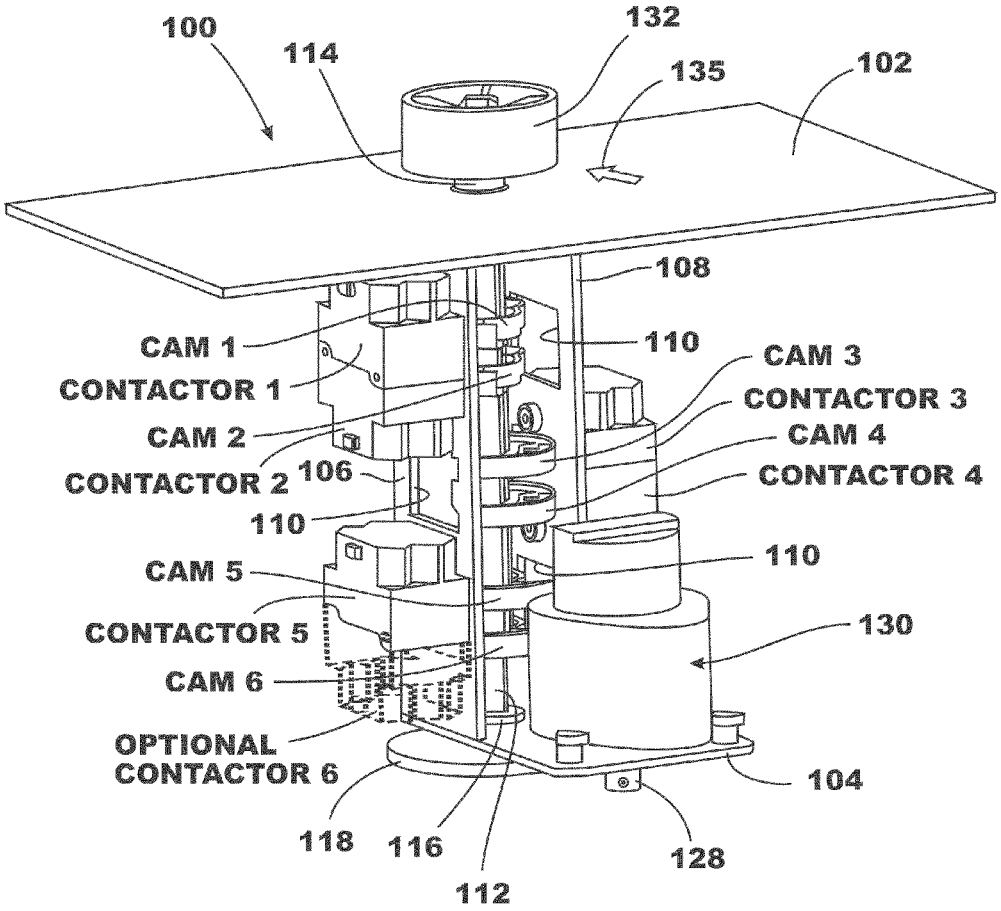
FIG. 10 is an isometric view of a cam timer such as can be used in the LLD compensation circuits of FIGS. 5, 6, and 7.
Figure 11:
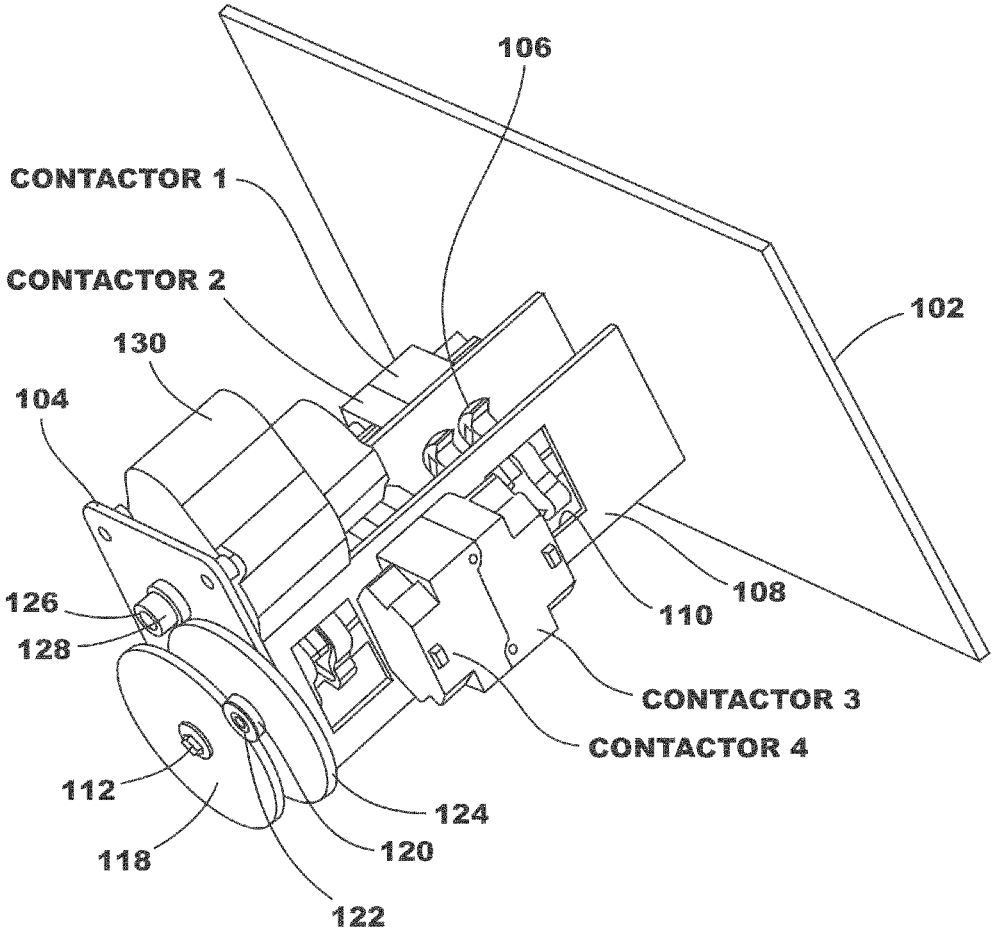
FIG. 11 is an isometric view of the cam timer of FIG. 10 from a different angle.
Figure 12:
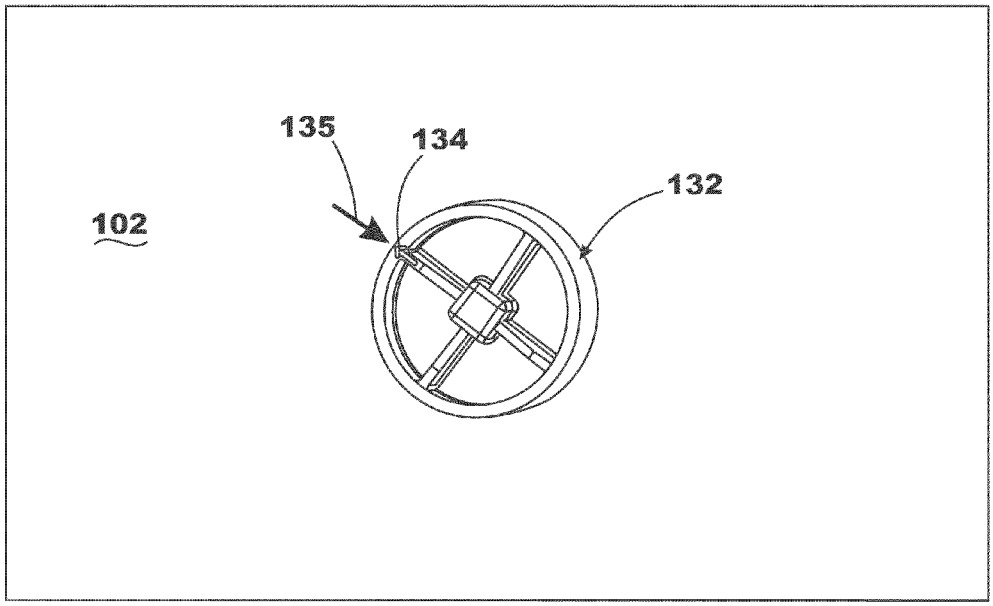
FIG. 12 is an isolated top plan view of a reset wheel for the cam timer of FIGS. 10 and 11.
Figure 13:
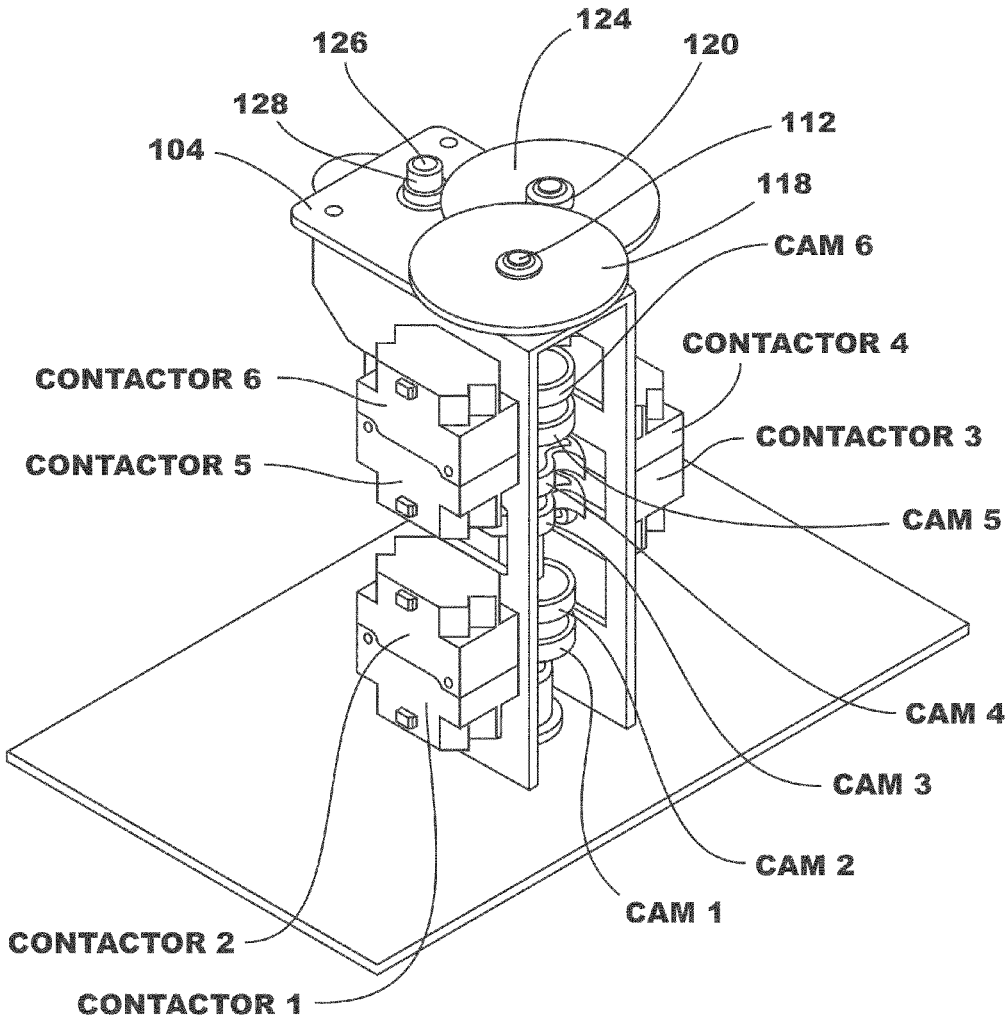
FIG. 13 is a perspective view of the cam timer of FIGS. 10-12 from a still different viewing angle.

Referring to FIGS. 10-12, standard gear motor 130 (Crouzet product #823040J2R4.32MW—including a motor capacitor) is mounted to end plate 104. Motor 130 can be fused (5 amp), as shown in FIG. 6. The size of motor 130 and its cams and contactors can be on the order of a few inches in length, width and height.

Gear motor 130 (a combination of an electric motor and gears) turns cam shaft 112 which is rotatably journaled at opposite ends in bearing 116 in end plate 104, and bearing 114 in mounting plate 102. Mounting plate 102 allows mounting of the entire cam timer assembly 100 into ballast box 20. A cover (not shown) can be placed around assembly 100.

Cam shaft 112 is rotated through a set of planetary gears. When motor 130 is on, motor axle 126 rotates pinion 128 (1.2 inch O.D.) at a small fraction of a revolution per hour (rph), specifically at 533 hours per rotation, which drives toothed gear 124 (2½ inch O.D.) which rotates on shaft 122 mounted to end plate 104. Gear 124 has a reduction gear 120 (½ inch O.D. toothed) fixedly mounted on it which abuts and drives cam shaft gear 118 (2½ inch O.D. toothed), which in turn drives cam shaft 112. The gear ratios are pre-designed to translate rotational speed of motor 130 to a desired rotational speed of cam shaft 112 to, in turn, rotate cams 1-6 at a desired rate (e.g. 13,300 hours per single rotation). The gears can be driven frictionally or by intermeshed teeth.

Contactors 1-6 are mounted on rails 106 or 108, as shown in FIGS. 10 and 11. Spring-loaded, normally outward extending switch heads extend through openings 110 in rails 106 and 108 to allow the cams to come into abutment. As can be appreciated, the pre-designed cams turn at the pre-designed fraction of revolution per hour (rph). They turn only when power is provided to a lamp 10. The cams are configured with eccentric parts or fingers on their perimeter to operate contactor switches positioned adjacent the cams. Although six cams and contactors are shown, not all have to be utilized. For example, less than six are needed to operate the switches of FIG. 6. In this example, each cam timer can control up to six lamps, which is the typical number for each ballast box in sports lighting applications. Furthermore, as indicated by contactor 6 (in ghost lines) in FIG. 10, contactors can be added or subtracted as needed, up to the capacity of assembly 100. Likewise, the number of cams can vary up to the physical space capacity for assembly 100.

In this example, contactors 1-6 are normally closed (NC) or conducting. The cam presses down an a spring-loaded plunger component of the contactor to hold it open (i.e. in a non-conducting state) until a cut-out portion of the cam reaches a certain point relative the plunger. At that point, the spring-loaded plunger, which until then had ridden along the cam falls off the cam (is not held down by the cam) and releases, and the contactor closes (becomes conducting). Once the plunger releases, the cut-out is designed so that it will not again lift the plunger back, until the whole cam timer is reset. The cams can be custom made to provide the cut-out at the right point. In this example, the cams are designed to cause three switches, at approximately 200 hours, approximately 1000 hours later, and then approximately another 1000 hours later.

In this way, assembly 100 effectively becomes a timer which monitors cumulative operating hours of its associated lamp 10. Motor 130 is inexpensive, and is low power, long life (e.g. $10^7$ operations), small, light weight, and durable (coil, no armature). It is synchronous for good timing characteristics. It is configured to drive in one direction only (e.g. needle bearing clutch), but like a washing machine cam timer, can be rotated in that direction to reset it to a starting position (e.g. when a lamp is changed). As indicated in FIGS. 11 and 12, a reset wheel 132 can have indicia (arrow 134, see FIG. 12), which allows a maintenance worker to easily see how far to manually rotate cam shaft 112 to reset it (by aligning arrow 134 on reset wheel 132 to a mark 135 on mounting plate 102).

Similarly, the cams are durable, relatively small, light weight and inexpensive. They can be precut using software by the manufacturer or specially ordered. They can also be custom built. They are slideably mounted on square shaft cam shaft 112.

Contactors 1-6 are also relatively inexpensive and small (Square D, either product KA3 for normally closed (N/C) or KA1 for normally open (N/O)). They are push button contactors (protected microswitches) capable of handling the amount of electrical energy supplied to lamp 10. They have environmental protection, including temperature robustness for almost any outdoors application. They also are protected against voltage variations.

Of course, there are a variety of ways such a timer could be configured to produce the functions indicated.

E. Advantages/Disadvantages

As can be appreciated, energy savings for each lamp 10 can be realized by operating the lamp at a reduced power level. These savings are compounded over the rather extended time involved (thousands of hours). Savings are also compounded in systems using a number of lamps. The result can be significant savings in energy usage, and thus cost.

A simple example is as follows. If electricity costs 7 cents/KW-hour, and a lamp is on for approximately 4 hours a day for a year, operation of that lamp would cost about $100.00/yr (1400 hours*$0.07). If approximately 20% less energy is used the first year by the lamp, a savings of about $20 would be realized. And, if there were 100 lamps for the lighting installation, a $2000 savings would result. Like compound interest, little gains may not seem significant, but over time, and compounded by multiple similar gains, it can be significant. Over thousands of hours of operation, total savings for each lamp, and for all lamps, would accumulate.

Furthermore, it may be possible to achieve savings by reducing the number of fixtures used in multi-fixture systems. For example, if it is known that later in lamp life light levels will drop substantially, a designer may "over specify" the number of fixtures in the hope that even when LLD has reduced light levels substantially, excess lights at the start will still provide a reasonable amount of light in that situation. With circuit 28A, light is periodically restored to initial specified levels, even later on in lamp life. Therefore, this can obviate a temptation to add extra light fixtures to the design.

Circuit 28A is relatively inexpensive, non-complex, runs off of line power, is uncomplicated, and does not interfere with other parts of lighting system. Furthermore, even if it fails, it would not affect the lighting system and energy savings would be realized for as long as it did work. It is estimated that over normal operating life of such lamps, a 10-15% energy savings over operating the lamp at rated operating wattage is possible on a routine basis.

F. Options/Alternatives

The foregoing examples are made for illustration only, and not to limit the invention. Variations obvious to those skilled in the art are included with the invention. A few examples are given below.

1. Generally

Various specific components can be used to practice the invention, such as is obvious to those skilled in the art. Variations in the regimen to practice the methodology of the invention are also well within the skill of those skilled in the art. A few examples are given below.

2. Lamps

As previously stated, the invention is believed relevant to most HID lights, including the various species of HID lamps (e.g. MH, Fluorescent, etc.), and whether jacketed or not, single or double ended. The invention may be most economically effective for higher powered HID lamps (e.g. at or over 400 W), but may have other advantages regardless of energy cost savings over time. It can be beneficial for an application using a single lamp, of for an application using a plurality of lamps.

3. Method of Setting Wattage Changes

Selection of the times to change wattage can vary according to desire or need. It has been found that time of operation is as predictable as anything upon which to base amount of lumen depreciation (cf. voltage, amperage, temperature, etc.).

Most of these types of lamps are predictable, including what happens when they are under-driven or over-driven. Also, most times the manufacturer will have available information regarding a lamp's LLD, LDF, etc. Therefore, a designer can literally select when to change lamp operating wattage based on a LLD curve for the lamp.

However, allowances can be made for other factors that affect light output of such lamps over time. For example, a designer could consider not only LLD, but also dirt accumulation on the lamp over time when selecting wattage changes and times.

4. Change Wattage

A variety of ways exist to change the wattage, the amount of energy, to such lamps at the desired times.

a) Add Capacitance

In the example of FIG. 6, capacitance in the lamp circuit is changed by deleting or adding capacitors. Capacitance was changed using switches. When added, wattage goes up; when decreased, wattage goes down (e.g. 28 μf=1260 W, 29 μf=1320 W, 31 μf=1440 W, 33 μf=1560 W, based on 32 μf=1500 W). The power factor does not change.

b) Ballast Taps

Figure 7:
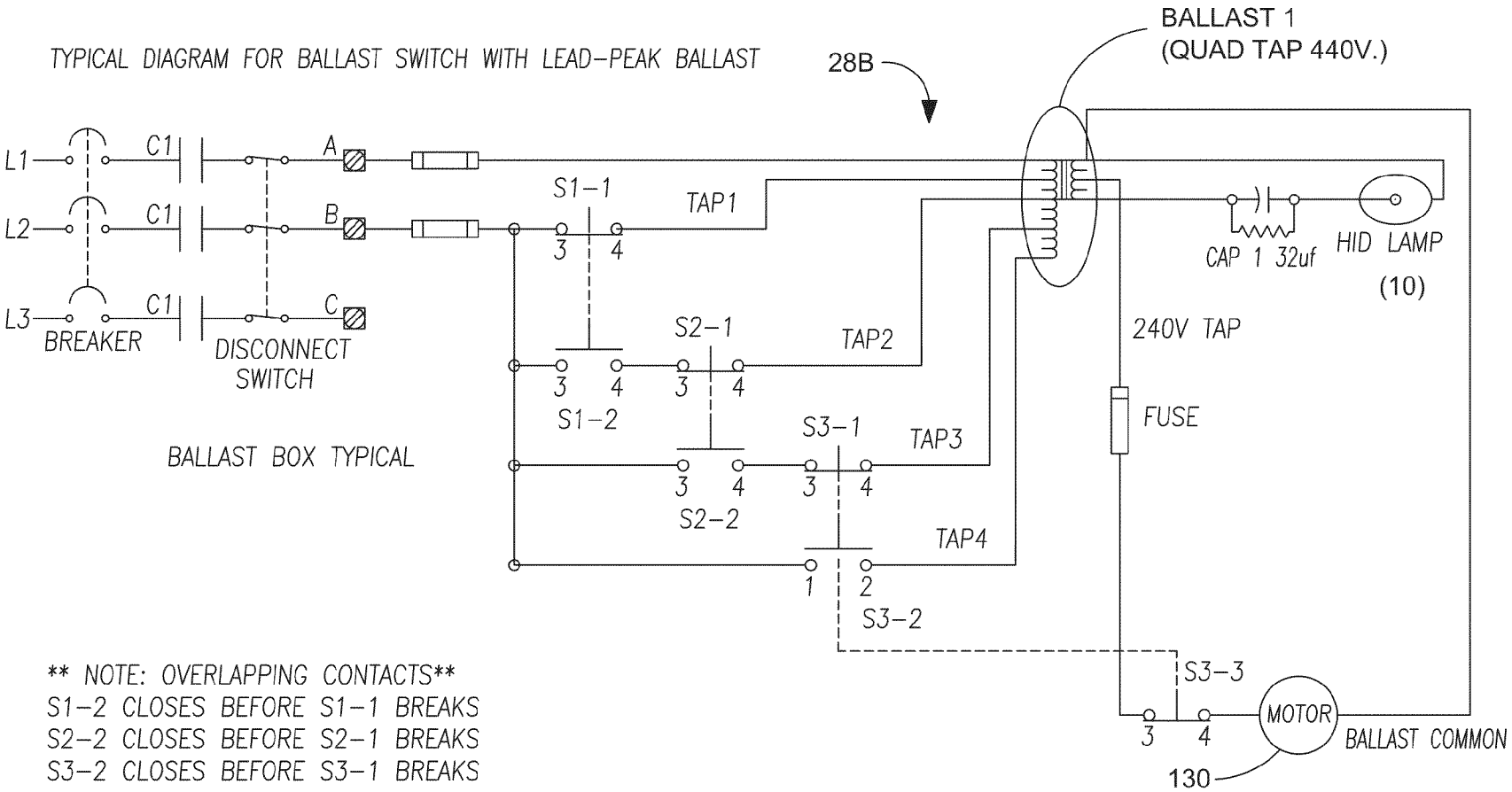
FIG. 7 is an electrical schematic of an alternative sub-circuit to that of FIG. 6.

FIG. 7 illustrates obtaining different operating power by using a switching network to select between different taps on a ballast (see FIG. 7, circuit 28B). Increasing amp flow, by changing taps in the primary side of Ballast 1, kicks in more capacitance.

In FIG. 7, line voltage fed to circuit 28B is 480V. Lead-peak Ballast 1 has four Taps1-4; 650V, 592V, 533V, and 480V respectively. A 32 μf capacitor CAP 1 is in line with lamp 10. Like the circuit of FIG. 6, cam timer 130 operates off of line voltage (240V, 0.1 A). Switch S1-1 (N/C) is the only current path through lamp 10 during the first period (e.g. T0-T1 or 200 hours) and causes lamp 10 to run at 1100 W.

At the end of the first period (e.g. T1 or 1200 hours), a cam of cam timer 130 would change the state of switch 1, which would open S1-1 but close S1-2 (N/O). Note that switch 1 is configured to close S1-2 before S1-1 breaks so there is assured continuity of power during the switching. Thus, 592V is now supplied to Ballast 1 (instead of 650V). This generates an increased power to lamp 10 of 1215 W during a next, here a second, timed period.

Similarly, at the end of the second timed period (e.g. until T2 or 2200 hours), cam motor 130 operates switch 2 to close S2-2 (N/O) and then open S2-1 (N/C), supplying 533 V to Ballast 1, or 1350 W to lamp 10.

Finally, at the end of the third timed period (T3 or 3200 hours), cam motor 130 closes S3-2 (N/O) and opens S3-1 (N/C), supplying 480V to Ballast 1 and 1500 W to lamp 10. Additionally, S3-3 (N/C) opens, shutting off motor 130.

The table below provides details regarding circuit 28B and its operation.

TABLE 2

Current lead ballast, quad tap 208 main
Equipment:
Quad-tap ballast
1500 w/Z-lamp w/@600 hours (manufactured by Philips, and available from Musco Corporation),
32 μf capacitor,
Type 6, SC-1 reflector w/lens (available from Musco Corporation, Oskaloosa, Iowa),
Minolta Meter/Cone
Yokogama Meter.
Electrical Service: 108 v, single phase
Procedure: lamp ran ½ hour after each respective ballast tap change

| BALLAST | PRIMARY | | | SECONDARY | | | MINOLTA/ |
|---|---|---|---|---|---|---|---|
| TAP | Watts | Volts | Amps | Watts | Volts | Amps | CONE |
| 208 | 1724 | 210 | 8.25 | 1630 | 302 | 5.94 | 196 |
| 240 | 1410 | 208 | 6.74 | 1340 | 293 | 4.88 | 160 |
| 277 | 1150 | 210 | 5.43 | 1079 | 271 | 4.49 | 105 |

c) Buck/Boost Transformer

A further example would be use of a buck/boost primary auto transformer (lead-push ballast with taps) (not shown). This is less sensitive to voltage. It can work like a reactor ballast. It may be less expensive than adding capacitors.

d) Linear Reactor Ballast

Figure 8:
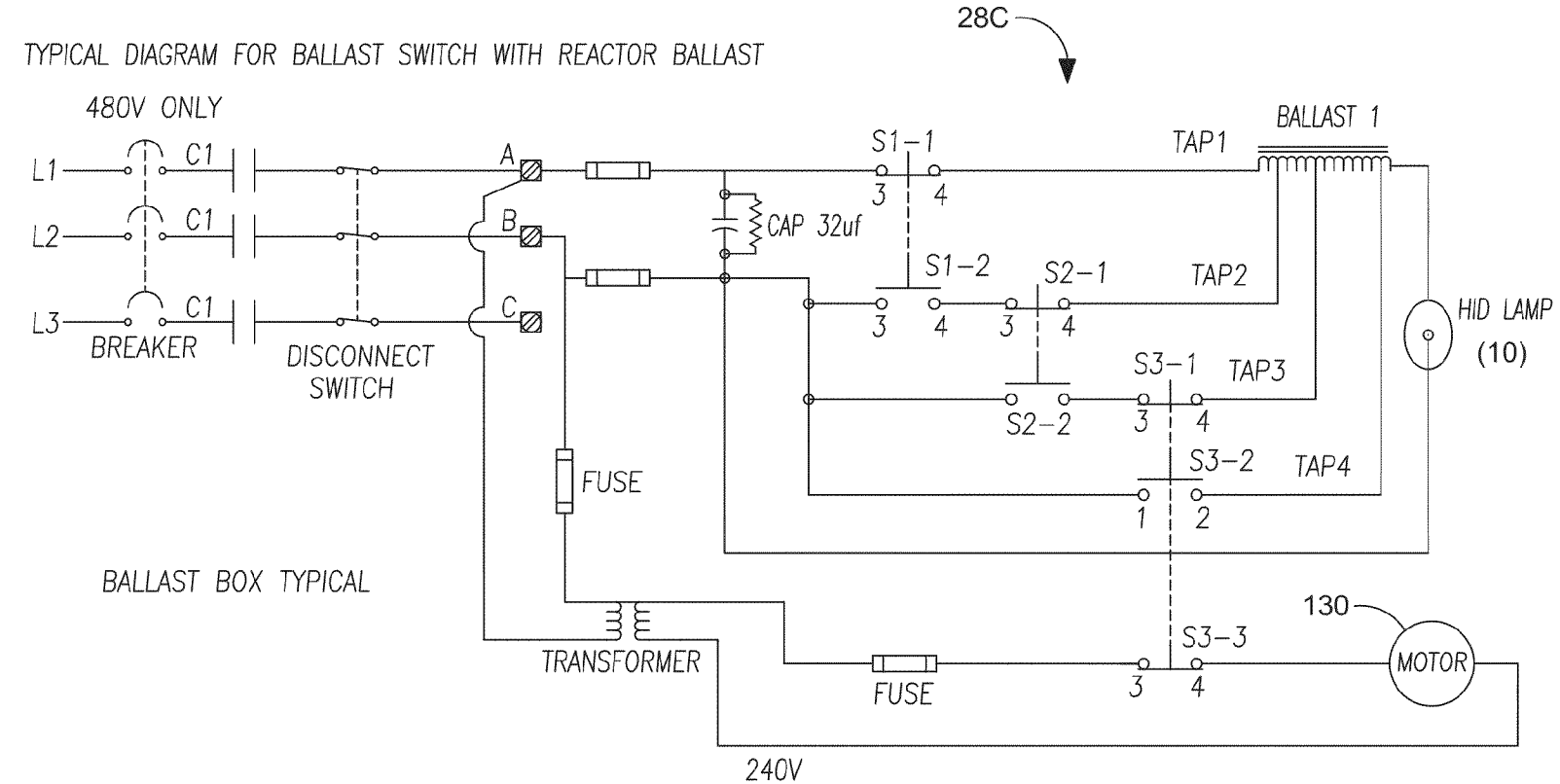
FIG. 8 is an electrical schematic of a further alternative sub-circuit to that of FIG. 6.

FIG. 8 illustrates circuit 28C with a linear reactor ballast ("ballast 1"). This is not a "true" ballast in that it does not convert voltage. However, similar to circuits 28A and 28B of FIGS. 6 and 7, circuit 28C would supply a first operating wattage to lamp 10 during a first timed period (by cam timer 130 powered by 240V). Switch 1 would have S1-1 (N/C) closed, providing the only current path through lamp 10 between inputs A and B. As can be seen this would utilize Tap 1 of Ballast 1. A 32 μf capacitor bridges the inputs A and B.

At the end of the first timed period, like circuit 28B of FIG. 7, S1-2 (N/O) would close before S2-1 (N/C) opens, which would switch the current path through S1-2 and S2-1 to Tap 2 of Ballast 1, increasing wattage to lamp 10.

Third and fourth wattages are supplied at third and fourth times by switching to Tap 3 (S2-2 (N/O), S3-1 (N/C)), and then Tap 4 (S3-2 (N/O)) of Ballast 1. When switched to tap 4, S3-3 (N/C) also opens or breaks to shut off motor 130.

With this method the reactor ballast taps are physically changed. This method is more sensitive to voltage.

e) Change Primary V

A still further example would be to change transformer taps at the transformer where power comes into the field. In other words, literally change the amount of voltage going to each of the ballast boxes 22 around the field being lighted. Thus, at one place, the operating wattage for all the lamps can be controlled.

Also a tapped transformer could be used for all of the lights on a pole. A time regimen could be used to change voltage to increase power. It could be arbitrarily feed, and bump out at increments such as 480V, 440V, 380V, and 350V.

Figure 9:
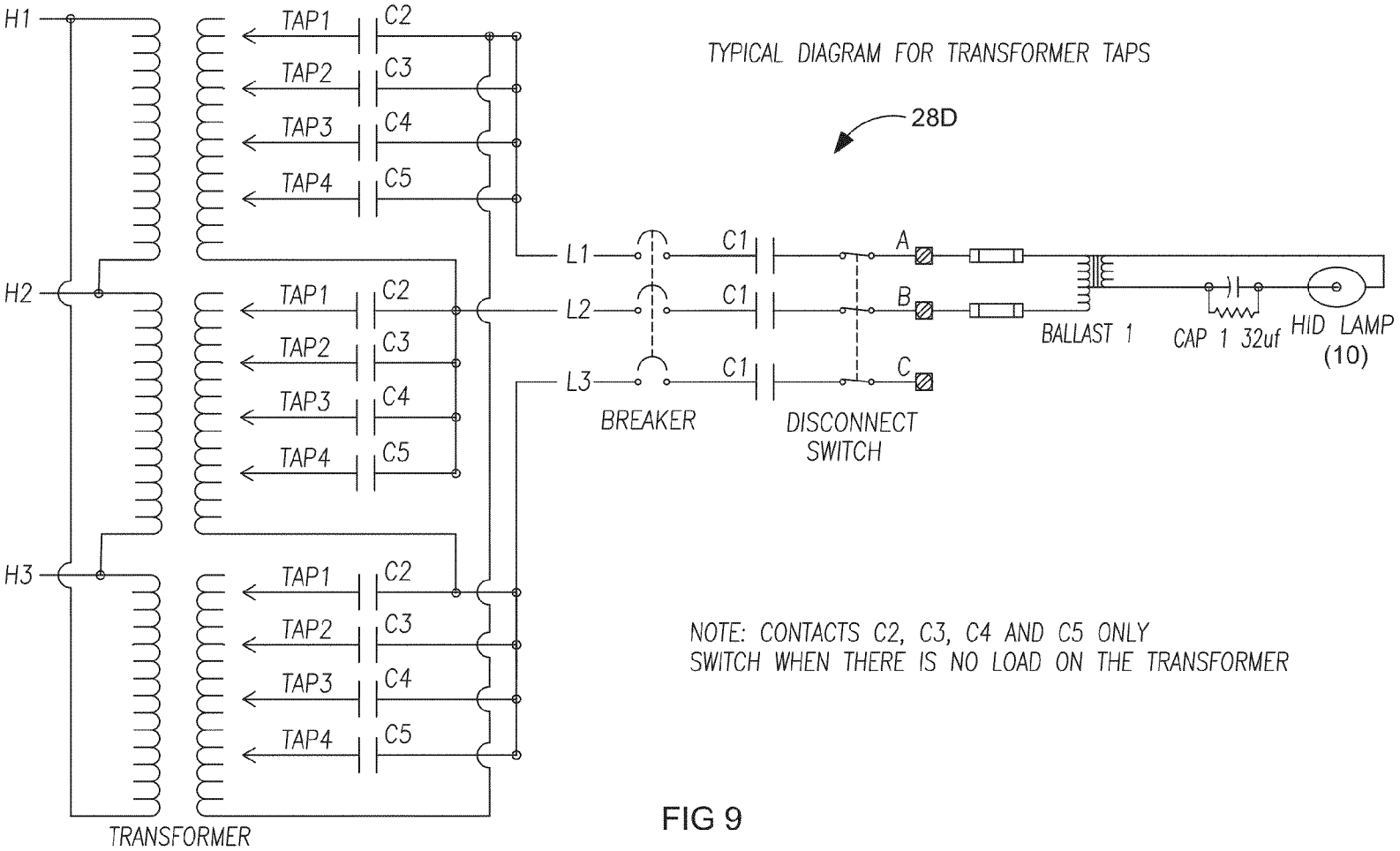
FIG. 9 is an electrical schematic of an alternative way to compensate for LLD for all lamps for a lighting system at a central location.

By reference to FIG. 9, circuit 28D accomplishes this by having multiple taps on each secondary of the transformer handling line voltage (H1-H2-H3) for the site (e.g. 3400 V, 6800 V, etc). Four different voltages can be produced for line voltage (L1-L2-L3) by selecting between Taps 1-4, which would be made available to all of the lamps in the system (via conventional ballast circuits such as illustrated for one lamp 10 in FIG. 9).

Contactors C2, C3, C4, C5 would be controlled to choose the desired tap. There are three sets of Taps 1-4 and Contactors 2-5; one set for each phase of the primary voltage. Each set of contractors C2 or C3 or C4 or C5 would be controlled together to select one voltage for L1, L2. Thus, similar to the lead peak embodiment of FIG. 7, when contactors C2 are closed (all other are open) and a first voltage (and thus a first operating power) is available to any lamps in the circuit via Tap 1. To increase wattage available to the lamps, C2 is opened and C3 closed to incrementally increase operating wattage by selecting Tap 2. Further increases are available by selecting Taps 3 or 4.

This differs from circuit 28B of FIG. 7. For example, there is no overlap in the switching needed because contacts 2-5 only switch when there is no load on the transformer. If there was an overlap, it could create a dangerous situation.

Switching of contactors C2-5 can be accomplished in a number of ways. One example would be to use a remote control system such as disclosed in co-owned, co-pending U.S. patent application Ser. No. 09/609,000, filed Jun. 30, 2000, and incorporated by reference herein. The operational status of each lamp can be monitored, e.g., whether each lamp is on or off, and how long the lamp has operated. A computer can keep track of the same and communicate with a remote computer via cellular telephone system control channels. At pre-programming times, instructions can be sent from the remote computer (after confirmation that no load is on the transformer) and can instruct contactors to open or close. With this method, no cam timer or other timer is required at the lighting site or in each ballast box 22.

Another example of a centralized control system would be CONTROL LINK™ by Musco Corporation. It uses the wireless internet to communicate from a central server to widely distributed controllers associated with lighting systems in different locations across the country, or even the world.

The taps can be selected to have a range of voltages. For example, they could be approximately 10% apart in magnitude of voltage. This would allow incrementally increases in voltage to all lamp circuits, and thus incremental increases in operating wattage, at pre-selected times, preferably timed to LLD. Even if a lamp reaches a time when its operating wattage should be changed, but it can not be changed because it is on (i.e. a load on the transformer exists), by programming and the intelligence of the local controller and the central computer, the system can wait until the lights are turned off to change the transformer taps. The flexibility of the method is such that even if the lamp operates, for example 210 hours instead of the programmed 200 hours, before its operating wattage is changed, it does not have a material effect. Rarely would entire lighting installations be on continuously for more than one half of day.

Therefore, the concept of FIG. 9 provides a change in voltage for all lamps of a lighting installation at one place in the overall circuitry. As can be appreciated, extra taps on the transformer can be reserved of other uses, e.g. concession stand lights and power. An extra transformer might be used for auxiliary power. Alternatively tap 1 or a bypass contactor.

This alternative may add some cost and complexity for primary transformer switching, as it may need to be switched while lights are off.

5. Selection of Time of Power Change a) Cam Timer

The cam timer 130 is a low cost, reliable de facto timer of lamp operation. Like electro-mechanical washer machine timers, cam-based timers with direct switching contacts have been developed over decades and have high reliability.

b) Electronic Timer

However, an electronic timer could be used. It could control relay contacts to effectuate switching. However, it would need to have appropriate components to supply it with electrical power. If based literally on keeping time of day, a battery back up would be needed to run it when the lamps are turned off, and no power to the system is available. A variety of such timers are available commercially.

Electronic or mechanical relays, contactors, or relay energized contacts could be controlled to make the switching changes.

Some disadvantages of electronic devices include susceptibility to damage or error caused by outside environment (e.g. lighting strikes). Also, the components tend to be relatively expensive (e.g. a microprocessor could cost $20 to $40). Associated structure, e.g. contactors, latch relay doubles, also could add to the cost. There is some unreliability inherent in such devices.

c) Computer/Microprocessor Control

Another example was discussed with U.S. Patent and CONTROL LINK™. A computer, either local or remote, would keep track of time and cumulative operation time of the lamps. The computers would control switching contactors. They could keep track of events and record when changes are made.

Such devices could be programmed at a factory. They might operate without battery by, like cam timer 130, accumulating timer of lamp operation by the time the electronic controller is operating.

6. Additional Options

Additional features could be used with the invention. There could be a bypass switch that bumps the lamp up to full rated wattage whenever selected. An example would be if there is a tournament when the lamps are brand new. There might be a desire to increase the lumen output for those first several hours, instead of running them at the bumped down wattage. Later the switch could be turned off and the lumen maintenance methodology described above could then take over or continue.

Also, there may be an issue of starting lamps at lower than rated wattage. If a choke is used, the power factor for the lamp may be questionable, especially on starting. There could be an automatic circuit that provides higher starting voltage and then drops back down to the lower operational voltage to overcome this problem (especially in cold weather). For example, the MULTI-WATT™ circuit by Musco Corporation, mentioned earlier, could be used for this purpose. Essentially higher wattage may be needed to kick in and fire up the lamp to heat up the electrodes (e.g. to reduce loss, then bump down). For example with a linear reactor ballast, it might be useful to bump operating wattage up to 125% of rated operating wattage at start to provide a "hot start" in cold weather. This could be accomplished in a number of ways, including many of the ways described in making wattage changes discussed herein. For example, another tap could be put on the reactor ballast.

As further indicated, the methods of the invention may actually also increase lamp life. By running under rated wattage, it is believed to lessen the slope of the LLD curve. This may increase lamp life because it operates without as much light loss over time. This may mean farther wattage bump ups should be made later in lamp life, especially if the lamp life increases because of the method.

Reset of the circuitry can be done in different ways. A reset button or dial (e.g. FIG. 12) could be manually operated when a lamp is changed. Alternatively, there could be a mechanical latch, which would not require contactors.

The invention is not limited to sports lighting. It is believed relevant to any light subject to lumen depreciation of an analogous nature. It can be applied to a variety of lamps, fixtures, and applications.

One variation of the method according to the invention is as follows. No changes in lamp operation are made during an initial time of operation of the lamp (e.g. the lamp is operated at ROW for the first 100 hours of cumulative operating time). The light output of the lamp, diminished some by LLD, becomes a "base value" output for the lamp. The lamp could then be run at ROW for an additional time (e.g. until 200 cumulative operating hours). At that point, operating wattage of the lamp could be bumped up to restore at least some of the lumen depreciation that has occurred. An alternative to the above method would be operate the lamp at ROW for the first 100 hours, then bump down for hours 100-200, and then bump up at a later time.

Another optional method that could be used with the invention is as follows. Operating wattage could be bumped up whenever light level drops below a predetermined threshold. For example, an average foot-candle (fc) level could be picked for a football field. Some type of measurement, including by automatic sensors, could monitor foot-candle level at the field. A signal could be generated if the fc level drops below the threshold. The signal could actuate an increase in operating wattage to one or more lamps lighting the field. The amount of increase could be selected from empirical testing. One example might be, if the desired light level was 100 fc, that each time light level at the measuring point dropped to 90 fc, an increase in operating wattage would be made to bring the light level back to at or near 100 fc. A graph of the light output from the lamps would look like a saw-teeth. It would drop (from LLD) to 90 fc, jump back up to 100 fc from a wattage increase, drop again to 90 fc, jump up again to 100 fc, and so on. Alternatively, a range of light levels (e.g. 105 fc to 95 fc) could be set and initially the lamps designed to provide 105 fc at the field. When the light level drops to 95 fc, bump it back to 105 fc through an increase in operating wattage to the lamps. This would tend to provide an average of 100 fc to field over time. Still further, if the desired level is 100 fc at the field, the initial design could generate 110 fc. When it drops to 100 fc, increase wattage to move it back to 110 fc. This way, the field should always have at least the desired lighting level. Other regimens are, of course, possible.

7. Discretionary Power Adjustment

As indicated above, there are situations or circumstances where it may be beneficial to have the ability to selectively or discretionarily alter or switch between light levels from one or a set of lights that exhibit the LLD characteristic. One example is the ability to dim one or more lights. Full or higher intensity from the source(s) may not be needed for certain times or circumstances. Dimming capability or use of lower intensity output from the light(s) allows reduced intensity but, at least in the case of ballasted lamps, also allows the ability to return to full intensity without substantial delay. Dimming usually results in energy savings. It also can provide other benefits.

A few specific, non-limiting examples of uses of dimming related to sports lighting follow:

| Higher light level | Lower (e.g. dimmed) light level |
|---|---|
| A game for a professional team | A game for an amateur team |
| An athletic game | Cleaning or maintenance of the field or the lights |
| A competition | A practice |
| A very dark night | A moonlight night |
| A cloudy day | A clear sky day. |
| A televised event | A non-televised event |

As can be appreciated, the ability to selectively change the light output from a light source can be advantageous in sports lighting contexts. When less light level is needed, energy can be saved, environmental lighting issues can be lessened (e.g. glare, spill, and halo effect), and other benefits can be possible. Additionally, it allows the lighting system and/or field to have greater flexibility. In sport lighting, for example, it can be both a competition level lighting system and a practice time lighting system. It can allow adequate lighting for a variety of environmental conditions (e.g. day/night; cloudy/non-cloudy).

Lighting applications other than sports lighting can also benefit from more than one light level. A few non-limiting examples are as follows:

| Higher light level | Lower light level |
|---|---|
| Work hours office interior lighting | Non-work hours office interior lighting |
| Night time parking lot lighting | Dawn or dusk parking lot lighting |
| Full auditorium lighting (full lighting of stage and spectators) | Limited auditorium lighting (full stage lighting but lower level spectator lighting) |
| Reading level room lighting | Lower level room lighting |

There are also situations where a temporary, even short, change in light intensity is desirable. One example would be to dim the lights for player introductions with a spot light. Another would be to signal the beginning of an event, such as the start of a play, a race, or a performance.

In all these cases, simply varying the intensity of the lighting is not the only issue. There must be a balancing of factors (e.g. economics, efficiencies, uniformity, intensity, length of lighting, surroundings, and regulations). Also, the nature of the light sources themselves can be a factor. For example, lamp lumen depreciation (LLD) is one of the characteristics of the nature of a light source that is relevant.

As can be further appreciated, some light sources have special characteristics over and above LLD. For example, with many HID sources, although they can be operated at reduced power levels compared to rated or nominal wattage, they must be started at a relatively high power level. Also, many types can not be dimmed by reducing power beyond a certain amount. If either of these rules is violated, it could result in non-functioning of the lamp or could cause malfunction or damage to the lamp or its normal life span. Therefore, each light source's characteristics must be considered when developing discretionary power adjustment to a light source that has an LLD characteristic that is being compensated.

a) Definitions

For the purposes of this document, the following terms have the following meanings GMLR:

GMLR is an acronym for the phrase "Greatest Minimum Lumen Requirement." In the context of this document, GMLR is meant to include the minimum lumen requirement for the situation which requires the greatest lumen level for an application. One example would be a minimum light level for playing a competitive baseball game on a field where practices can be held at lower levels. The requirement does not have to be fixed or narrowly defined, for example the GMLR for a target or space could be a lumen level sufficient to allow comfortable reading. However, the requirement could be more narrowly defined, such as a specific lumen level or range of lumen levels for a target or space. GMLR can be for an individual lamp or light source, or for plural lamps or light sources (e.g. a light intensity and/or uniformity minimum for an area or space lighting by but a distance away from a plurality of lamps or light sources which are coordinated to compositely illuminate the area or space).

Controllable Factor:

The term "controllable factor" is meant to include factors which influence lumen output for a light source which can be manipulated in a fashion so as to exhibit a degree of control over the lumen output of a light source. An example of a controllable factor could include electrical power supplied to a light source. As is well known by those skilled in the art, electrical power can be adjusted in a variety of ways (e.g. adjustment of voltage, current, resistance, etc.).

Actuator:

The term "actuator" is meant to include any means, apparatus, system, or method of manipulating or otherwise controlling at least one "controllable factor." These means can include any form of mechanical, electromechanical, biological, or other device or method designed to, and/or capable of, manipulating or otherwise controlling a "controllable factor."

Timer:

The term "timer" is meant to include any means, apparatus, system, or method of measuring or approximating the passage of time or some other quantity related to time. Nearly any apparatus or method useful in measuring or approximating the passage of time could be used as the timer[s] in this invention. It is necessary only that the timer be able to approximate the passage of time to a degree of accuracy useful to the end user or application. In the context of this document this includes measurements or approximations of anything known to, or can be approximated as, occurring at a rate.

Discretionary Adjustment of Lumen Output:

The term "discretionary adjustment of lumen output", for purposes herein, is meant to include not only selective manual selection of change from one lumen output to another substantially different lumen output, but also programmable or sensor-activated changes, and in a general sense includes most lumen output adjustment other than LLD compensation. Typically it would refer to an end-user-selectable (e.g. buyer or customer of the lighting system; or owner or user of athletic field; or operator of the venue or lighting system) non-permanent alternative lumen output for the target or space to be lighted for some desired illumination reason, as opposed to some operation reason of the lamp or light source. This is in contrast to a non-end-user-selectable function. One example could be the LLD compensation, which could be set by the manufacturer of the lighting system to operate automatically and autonomously of the end-user, unless over-ridden by the end-user.

b) Summary of Aspects of Discretionary Light Levels for Light Sources with LLD Characteristic A need in the art has been identified to provide for lighting apparatus or systems which can allow for greater flexibility in terms of lumen output, more consistent lumen output, use of less energy, and/or extended life of one or more light sources that has/have an LLD characteristic which is being compensated. In a general embodiment this is accomplished as follows.

A light source having an LLD characteristic and whose lumen output is at least partially dependent on controllable factor[s] is selected for a particular application. A lumen depreciation curve or characteristic (e.g. for some light sources called a lumen depreciation factor or maintenance factor) for the light source is obtained, measured, or approximated for intended operating levels. As mentioned previously, most light source manufacturers publish or provide such information regarding their lights. The relationship between the light source's lumen output and the controllable factor[s] is obtained, measured, or approximated. From an analysis of a particular application (and its possibly various needs), lighting requirements are identified. These lighting requirements may include, but are not limited to, a GMLR for lumen output, alternate minimum lumen output levels, lighting levels which require lumen depreciation compensation, maximum lumen outputs, or the point at which the light source is deemed no longer functional and must be replaced. A set of one or more initial lumen output level[s] and the corresponding setting[s] for the controllable factor[s] are identified through analysis of the information regarding the lighting requirements and the relationship between the light source and the controllable factor[s].

The light source is connected such that there is an actuator which can adjust the controllable factor[s] and can be switchably operated to obtain desired lumen output level[s]. For level[s] which will implement lumen depreciation compensation, a minimum lumen output point is identified. This is the point where the controllable factor[s] will be adjusted by at least one actuator to return the lumen output to, or near to, the original output for that level. The lumen depreciation curve for the particular light source is used to identify or approximate the operating time when the light source will reach the minimum lumen output point. A timer[s] is operatively connected such that at least one actuator is signaled or informed at these operating times when the light source is predicted to fall to minimum lumen output levels. The known or approximated relationship between the light source and the controllable factor[s] is used to identify setting[s] for the controllable factor[s] that will result in correcting the lumen output for the light source to, or near to, the original lumen output for that level. This process is repeated for as many corrections as is decided to be necessary for each level.

It is envisioned that there are a number of ways to signal or inform an actuator. This aspect of the invention is not to be limited by the method by which an actuator which adjusts a controllable factor is signaled or informed. It is further envisioned that sensors and other devices that monitor controllable factors or lumen output could be made to communicate information that results in an actuator adjusting a controllable factor. It is envisioned that this communication could take place over guided media, wirelessly, or through some combination of both. It is further envisioned that such communication, as well as signaling or instructions to signal or inform any actuator could occur on-site by manual operator or user activation, or through some remote control. In this sense, discretionary adjustment of light output of one or more fixtures is provided. One example of remote control signaling can be found at U.S. Pat. No. 6,681,110 and available commercially from Musco Corporation under the brand name CONTOL-LINK™.

This optional embodiment of the invention can result in significant energy, and therefore cost, savings due to the implementation of lumen depreciation compensation, switchable lower levels of operation, or both. In the case of lumen depreciation compensation, a light source can be operated within an envelope of power levels which includes levels above and below its rated or nominal wattage. For example, a 1500 watt metal halide HID light source may be operated in the range of 1200-1800 watts. This envelope will be consistent with recommended operating levels suggested by the American National Standards Institute (ANSI), light source manufacturers, or other governing bodies. It is possible to operate such a light source at power levels at the lower end of this envelope and still achieve a useable lumen output without risk of damage to the light source. This can be done for an extended period of time and result in an energy savings while maintaining desired lumen output. It is also possible that, for some applications, the costs associated with replacing light sources is such that it is economical to continue operating a light source at higher energy levels even if a net energy savings is not realized due to the ability to delay replacement of the light source while still achieving desired lumen output.

It is envisioned that this embodiment would be especially useful for many applications. One example to help illustrate, but not limit, the current invention is an indoor basketball court. A user, such as a school, would be able to operate at reduced lumen output levels for situations like daily lighting, gym classes, and practices, while being able to achieve high levels of lumen output for situations such as games or tournaments. Example of other applications could include, but are not limited to, other athletic venues, street or parking lot lighting, signs, mobile lighting systems, general outdoor lighting, general indoor lighting, or any application that could benefit from more stable lumen output levels, lower energy usage, or a variety of lumen output levels.

For a better understanding of this discretionary power adjustment embodiment, a specific exemplary embodiment will now be described in detail. This embodiment is by way of example and illustration only, and not by way of limitation.

c) Example 4

One application of this example relates to high intensity discharge (HID) lighting, a family of light sources which displays a lamp lumen depreciation characteristic and whose lumen output is at least partially dependent on a controllable factor, in this case the power applied to the light source. A model of lumen depreciation for various HID lamps operating at various power levels, and the relationship between lumen output and applied power for the various HID lamps, is known or can be approximated.

Using the known or approximated lumen depreciation curve or characteristic for the specific HID light source being used, it can be approximated when the lumen output of the HID light source will reach a particular lumen output as a result of lumen depreciation. A particular level of lumen output can be chosen where the power applied to the HID light source will be adjusted such that the lumen output of the HID light source will adjust to a desired level. The particular level at which the HID light source will be adjusted will have corresponding approximate operating time as predicted by the lumen depreciation curve or characteristic for the HID light source. The earlier examples in this document, also set forth in U.S. Pat. No. 7,176,635, describe methods to identify operation times and make adjustments.

In this example, a timer[s] will operate only while the light source is operating and will track the time of operation. This timer[s] will signal or inform adjusting means, in this case at least one actuator, when it is time to adjust the power to the HID light source. After the adjustment, the HID light source will operate with a new applied power and will continue to experience lumen depreciation. With the known or approximated new operating power, it is again possible to use a lumen depreciation curve to predict when the light source will decay to a particular level and need to be adjusted again. This process can continue until the light source is no longer operational, or until it is no longer economical to apply the higher power to the light source. Any number of adjustments can be made at any particular lumen output level.

One aspect of this example is that it is also possible to include one or more other lumen output levels. They can be elected and activated at any time. As discussed earlier, an application may only need to operate at GMLR for select situations and therefore would benefit from being able to operate at lower levels. Applications may have a situation[s] where the lumen output requirement may only be some fraction, or set of fractions, of the GMLR. For this situation[s], the lighting system will be able to switchably operate at the predetermined alternate lumen output levels. The changes can be made with discretion of the lighting system designer or the operator/user. In one version, the operator or user of the system can select the desired level at virtually any time. Depending on the situation and application, lumen depreciation may or may not be significant factor at these alternate lumen output levels. In the situations where lumen depreciation at alternate lumen output levels does not need compensation, the switchable alternate levels might not have a means to compensate for lumen depreciation. In situations where lumen depreciation at alternate lumen output levels is a factor needing compensation, means can be included to compensate for lumen depreciation at these alternate levels.

An optional device that could be used with this example is a variable capacitance capacitor. A variable capacitor is a capacitor whose capacitance may be intentionally and repeatedly changed mechanically or electronically. Variable capacitors are often used in inductance/capacitance (L/C) circuits to set the resonance frequency, e.g. to tune a radio (therefore they are sometimes called tuning capacitors), or as a variable reactance, e.g. for impedance matching in antenna tuners. They are commercially available in a variety of sizes and ranges. These devices can vary their capacitance within some range and could reduce the amount of discrete capacitors needed to meet the needs for alternate lumen output levels. Other variable property components, such as variable resistance resistors or variable inductance inductors, could also be useful to more effectively control the lumen output of light sources in other embodiments. Variable capacitors do tend to add cost and complexity to the circuit, however. The designer can consider these factors.

As applied to HID lighting, the current example is implemented as follows. The lumen depreciation compensation aspects of the invention are implemented through the apparatus and method previously discussed with respect to FIG. 6 (see also U.S. Pat. No. 7,176,635, hereafter referenced as Gordin 635). The switchable alternate lumen output levels are implemented in a similar manner to the method of U.S. Pat. No. 4,994,718, hereafter referenced as Gordin 718.

Two detailed versions of this example of discretionary adjustment will now be outlined. The structural implementations are modifications to the circuit of FIG. 6 into the circuit of FIG. 14 or 15. The primary, or base, capacitor, in this case CAP 1 of FIG. 6, is replaced with a smaller capacitor, CAP 1 of FIG. 14 or 15. Another capacitor is added, CAP 5 (see also reference number 301) of FIG. 14 or 15, which is wired in parallel with capacitors 1 through 4, as illustrated in FIGS. 14 and 15. Additional switchably connected capacitors could be added to accommodate additional lumen output levels.

Typically the equivalent capacitance, as implemented in the circuit of the new base capacitor and any additional capacitors, will approximately total the capacitance of the previous base capacitor as it was previously implemented in the circuit (e.g., the 28 μf base CAP 1 of FIG. 6 would be replaced with a base CAP 1 of FIGS. 14 and 15 of a lesser amount, however, the sum of capacitance of base CAP 1 and new CAP 5 would normally equal to or be near 28 μf). Note the example in FIGS. 14 and 15, the new CAP 5 would be substantially less than 28 μf. For example, it would be of a value that would result in a substantial reduction in light output of the light source (e.g. on the order of 20-70%). One skilled in the art, applying well-known principles of physics, would select the capacitance value of CAP 5 to produce the desired dimming of light output.

The designer should keep in mind that the selection of capacitance value of CAP 5 should not be so much that it would result in operating power to the light to go below the amount needed to sustain operation of the light. As discussed previously, at least with some HID lamps, if insufficient power is provided they will not sustain operation. Those skilled in the art know or can find out the lower limit from the lamp manufacturer, or empirically determine the same.

In most cases substantial dimming means more than 30%, as the human eye tends not to be able to detect less than 30% decrease in light output. However, in some cases less than 30% dimming could be used. For example, even if a player can not see a less than 30% drop in light level, it would prevent overlighting and keeps energy usage to a minimum. Furthermore, even if an athlete can not consciously notice a less than approximately 30% dimming, he/she may have more trouble seeing the flight of a ball, for example. Thus, even dimming of less than around 30% can have benefits and effects.

In order to implement the MULTIWATT™ system, it is important to know the required capacitance to operate the particular light source at its highest envisioned emission levels. The sum of all the capacitors implemented in the MULTIWATT™ system must approximately equal this value. The number and size of the capacitors used is dependent on the requirements of the end user. Enough capacitance must be available, through one or more capacitors, to provide enough voltage to start the light source, and to maintain enough voltage to the light source to maintain operation. A known relationship exists between the capacitance supplied to the lighting system and the voltage applied to the light source, between the voltage applied to the light source and the level of emitted light from the light source, and the level of emitted light from the light source and the lumen level at a target. These relationships can vary between lighting systems, light sources, and venues, but someone skilled in the art would have knowledge of these relationships. Using this knowledge, it is possible to designate capacitance levels which will correlate to particular lumen output levels which in turn will correlate with lumen levels at a target.

For example, the designer would start with desired light output. Using the known relationship between capacitance and light output for such lamps, the designer can select the capacitance value for CAP 5 and reduce the capacitance value for base CAP 1 a like or similar amount for a given desired dimming reduction.

The customer or end-user has various choices. For example, if the customer wants to save energy as a primary goal, a bigger reduction of operating power through a bigger CAP 5 can be implemented. This would represent a significant energy savings when in dimmed mode.

On the other hand, if the customer wants a certain dimmed level of lesser amount, a smaller CAP 5 can be used. The table below gives examples of these choices:

TABLE

| LOW MODE OPERATION* | | | |
|---|---|---|---|
| LIGHT LEVEL OPTIONS | LIGHT OUTPUT (FOOTCANDLES) | ELECTRICAL CONSUMPTION (WATTS) | ENERGY SAVINGS |
| 1500 Watt | | | |
| 1. 1500 w/1000 w | 50% | 67% | 33% |
| 2. 1500 w/600 w | 20% | 40% | 60% |
| 1000 Watt | | | |
| 1. 1000 w/667 w | 50% | 67% | 33% |
| 2. 1000 w/400 w | 20% | 40% | 60% |

High mode operation has 100% electrical consumption of 100% light output.

*Energy consumption my fluctuate due to normal operating characteristic of the lamp and ballast.

A contactor 302 can be implemented in one of two locations in the circuit depending on whether lumen depreciation compensation is needed for the alternate lumen output level. If lumen depreciation compensation is not needed for the alternate lumen output level, contactor 302B is implemented after the wire divergence immediately before CAP 1 but before the wire divergence leading to S1 as illustrated in FIG. 15. If lumen depreciation compensation is needed for the alternate lumen output level, contactor 302A is implemented after the wire divergence between CAP 4 and CAP 5, but before CAP 5 as illustrated in FIG. 14.

The circuit in FIG. 14 operates as follows. A timing means, in this embodiment motor 130 (as earlier described), runs while the light source is operated and has a cam that, at predetermined operating times, throws switches S1, S2, and S3-1. As these switches S1, S2, and S3-1 are thrown, CAP 2, 3, and 4 are added to the circuit respectively. This increases the capacitance in series between the power source and the light source, and increases the wattage applied to the light source. This in turn increases the lumen output of the HID lamp used in this embodiment by known laws of physics. These functions are described in detail with respect to the earlier embodiment of FIG. 6. If the alternate lumen level is selected, than the MW CONTACTOR (reference number 302A in FIG. 14) is thrown and CAP 5 is removed from the circuit. MW CONTACTOR 302A could be thrown by merely adjusting a switch on a wall, although it could be thrown by a timing means, or a number of other methods known to the skilled artisan. Throwing MW CONTACTOR 302A removes capacitance from the circuit and reduces the wattage applied to the HID lamp which in turn reduces the HID lamp's lumen output. Even though CAP 5 has been removed from the circuit, CAP 2, 3, and 4 remain available to be switched into parallel with lamp 10 (per operation of the SMART LAMP™ sub-circuitry which automatically provides LLD compensation for lamp 10. These capacitors were added to compensate for the LLD lumen depreciation characteristic of the light source. In the embodiment of FIG. 14, the benefit of only removing CAP 5 is that the lumen level for the alternate lumen level will be more constant throughout the life of the light source. In other words, the lower output of lamp 10 will automatically be periodically adjusted towards a constant lumen output over some period of the normal operating life of lamp 10. Discretionary lumen output adjustment (here dimming) of lamp 10 by removal of CAP 5 from the lamp circuit will cause a reduction or dimming from that approximated constant normal full light level by a relatively proportional amount. Thus, the dimmed level will also be relatively constant.

The circuit in FIG. 15 is a slight variation to that of FIG. 14. It operates in a similar fashion as the circuit in FIG. 14, except for the consequences of throwing its MW CONTACTOR 302B. Because of the different location of MW CONTACTOR 302B, when it is thrown it removes not just CAP 5, but also CAP 2, 3, and 4 from the circuit. This removes not only the capacitance difference that distinguishes the alternate lumen output level, but also the capacitance that was added to compensate for lumen depreciation. Thus, the alternative lumen output of the circuit of FIG. 15 is still a proportional offset to the normal full light output of lamp 10, but its actual lumen output value will decrease over time because of LLD (and the fact that LLD compensation is removed when CAP 5 is removed from the lamp circuit). For example, if MW CONTACTOR 302B is actuated late in the normal operating life of lamp 10, the alternative lumen output (the dimmed level) will be much lower than the alternative lumen output (the dimmed level) created when MW CONTACTOR 302A of FIG. 14 is actuated. This may be, however, acceptable as dimming normally does not demand or require a precise lumen level or precise offset from a normal full level. An advantage of the circuit of FIG. 15 is that, in situations where lumen depreciation is not a significant concern, the light source will operate at a lower wattage level and more energy savings can be realized.

Therefore, in Example 4, instead of using just the SMART LAMP™ circuitry (e.g. an example of which is shown at FIG. 6), a new capacitor (e.g. CAP 5) and relay (or contactor) (MW CONTACTOR or ref no. 302A or B) can be added in parallel with the SMART LAMP™ circuitry. Such a capacitor/relay combination could be selected to allow operating power reduction of whatever reasonable amount is desired. By "reasonable amount" is meant there may be some limits as to how much operating power drop can be done without materially affecting operation of the lamp. For example, it is believed a reduction to approximately 1100 Watts for a 1500 Watt nominal operating power lamp is the lower end of the range starting the lamp. Lower than that probably requires an initial high wattage (e.g. at least 1100 Watt) at lamp start up to provide sufficient start-up power and stabilization of the lamp, which would take additional time and circuitry. This could be somewhat counterproductive to the energy saving advantage aspect discussed. Those skilled in the art can empirically or with lamp manufacturer information derive or deduce reasonable operating limits. However, it is envisioned that the operating wattage range could go lower, e.g. perhaps to 700 Watts or so, if there is an initial "high wattage" start up.

FIG. 16 is a flow chart 300 which is intended to give a general illustration of operation of the circuit of FIG. 14. This is similar to the flow chart of FIG. 2, which illustrates the SMART LAMP™ method, with the following primary differences.

FIG. 16 illustrates the addition of discretionary alternative lumen output levels L1, L2, . . . , LN. Any of these alternative levels can be selected by the user or by some means or method designed into the system, but which is intended to allow for selective or discretionary illumination level adjustment, rather than LLD compensation. In effect, the alternative lumen output level choices L1, L2, . . . , LN are the MULTI-WATT® equivalent of the process and is indicated at reference number 302 in broken lines. Although a typically MULTI-WATT® implementation has just two alternative lumen output levels (e.g. a full and a dimmed), FIG. 16 is intended to illustrate for exemplary purposes that more than two alternative levels could be possible. Such could be implemented by adding additional capacitors in parallel with CAP 5 and contactors which could selectively switch those additional capacitors in or out to the lamp circuit.

As indicated in FIG. 16, a timer (e.g. timer 130) would start cumulative operating time timing when a new lamp is first turned on (see steps 309, 310 and 312). By manual switch or other means or methods, one of the alternative lumen output levels L (e.g. L1, L2, . . . , LN) is selected by operation of the MULTI-WATT® type system 302 (actuation or no actuation of MW CONTACTOR 302A in the two lumen output level system of FIG. 14). If L1 is assumed to be full level (e.g. where CAP 5 is switched into the lamp circuit of FIG. 14), the system operates according to steps 316-328, so long as the lamp is operated at level L1. Essentially this means that the lamp would run at an initial controllable factor setting A1 (step 318) until the end of a first timed period (until T=T1) (step 316). In the example of FIG. 14, the controllable factor is capacitance and setting A1 would be to run lamp 10 with CAP 1 (base capacitor) and CAP 5, which is the full or high lumen output for the lamp.

At T1, a controllable factor would be controlled (it would be adjusted to different controllable factor setting A2—see step 322) until time T2 is reached. Setting A2 would switch in CAP 2 of FIG. 14 to increase operating power to the lamp to compensate for LLD at that point in the operating life of the lamp. So long as initial level L1 remains selected for the lamp, it would periodically change to a new controllable factor setting A at the end of each time period.

As indicated in FIG. 16, these periodic changes in controllable factor setting A can continue for a plurality of times up to TN. So long as L1 is selected, it would automatically change controllable factor setting A at the end of each pre-set time period until a last time TN (step 324) is reached, at which time the lamp would change from setting AN (step 326) to setting A (final) (step 328) and the timer would be shut off (step 370). In the example of FIG. 14, the timer 130 is shut off because no further automatic timed LLD compensation adjustments will be made at this point in the lamp's operating life. This is essentially SMART LAMP™ operation (and is indicated generally inside dashed line 304A) of FIG. 16.

However, if lumen output level L is ever switched, the method checks time T and runs the lamp at a controllable factor setting pre-designed for that time T. As indicated generally in FIG. 16, if for example the lumen output level is changed from L1 to L2 (step 330), if T<T1 (step 336), the lamp would automatically run at controllable factor setting B1 (step 338). In the case of FIG. 14, this could be actuation of MW CONTACTOR 302A, which would remove CAP 5 from the lamp circuit and thus dim lamp 10 a proportional amount. In essence, setting B1 would be the same as setting A1. However, if desired, B1 could be different from A1. It could simply be a different capacitance amount, or it could be a different controllable factor. Therefore, as time progresses, at the end of each timed period, the method could automatically adjust the controllable factor setting until time TN, when a final setting B (final) would be set (step 348) and the timer would be stopped (step 370).

As can be appreciated, the method of FIG. 16 contemplates that automatic timed adjustment of a controllable factor can occur for each discretionarily set lumen output level L1, L2, . . . , LN. In the example of FIG. 14, method 300 would simply compensate for LLD by automatically switching in CAP 2, CAP 3, and CAP 4 if the correlated times T2, T3, and T4 are reached. Thus, whether in full or dimmed lumen output state L1 or L2, LLD compensation would occur. As discussed previously, this would not only keep the full light output level of the lamp relatively constant over its operating life, but every time the lamp is dimmed, the offset (the drop) in lumen output would be relatively the same. Essentially the SMART LAMP™ method of LLD compensation, as an example, would be available for alternative lumen output setting L2 (see dashed line 304B in FIG. 16), as well as for additional lumen output levels, if any (see dashed line 304B in FIG. 16).

But note that FIG. 16 also illustrates how the circuit of FIG. 15, in the alternative, might work in method 300. At a first lumen output level L1 (e.g. full power), the lamp circuit would work as described above. So long as L1 is selected for the lamp (e.g. full light), controllable factor settings A1, A2, . . . , AN would be automatically implemented at the appropriate times T0, T1, T2, . . . , TN. In the example of FIG. 15, this would be periodic increases in capacitance to compensate for LLD by switching in CAP 2, CAP 3, or CAP 4. Therefore, in the example of FIG. 15, a relatively constant or consistent lumen output level would be automatically maintained for the lamp over its operating life. However, if L1 was discretionarily switched to L2 (see step 330 in FIG. 16), in the embodiment of FIG. 15, the lamp would be run at controllable factor setting B1 for as long as L2 is selected, regardless of time T (see dashed line 331). In the embodiment of FIG. 15, this means that when MW CONTACTOR 302B is actuated to switch CAP 5 out of the lamp circuit (to dim the lamp), regardless of whether it is between time T0 and T1, between T1 and T2, or any other time, the lamp would be run at base capacitor CAP 1 capacitance and that no LLD compensation would be included. None of CAPS 2, 3, or 4 would be added. As discussed above, this may be acceptable for many applications. One reason is that this could save energy. But further note that if L2 is switched back to L1 (step 314), depending on the time T, the controllable factor setting will be automatically selected. In the example of FIG. 15, if the lamp is switched from a dimmed state (L2) back to a full state (L1), LLD compensation appropriate for the cumulative operating time of lamp 10 will automatically be reinstated. Time T continues to be monitored and cumulated even if a dimmed state is selected. Alternatively, the sequence of steps 330-348 could be used, but the controllable factor settings could be the same (e.g. B1=B2=BN=B (final)).

As indicated in FIG. 16, additional lumen output levels can be made available (see steps 350-368 of FIG. 16). These additional options can be with the controllable factor timed adjustments (steps 560-568) or without (see reference number 351, which would bypass steps 560-568). For example, there could be a medium dimmed alternative level to full light output for the lamp, and a maximum dimmed alternative level, that would be possible by the addition of a CAP 6 in parallel with CAP 5, and another contactor to switch CAP 6 in or out. The capacitance values of CAP 5 and 6 could be selected to correspond with medium and maximum dim. By design, the medium and maximum dim states could either include LLD compensation or not, as indicated above.

Also, as indicated above, the controllable factors and/or their settings and levels could be the same (e.g. A1=B1=N1; A2=B2=N2, etc.), or they could be different in amount or type. For example, controllable factor A could be capacitance, controllable factor B resistance, and so on.

d) Advantages

There are several advantages to the circuits of Example 4. One key advantage is that significant energy savings can be realized by operating lights at lower energy levels early in a light source's life span as is possible with the lumen depreciation compensation method, or by operating the lights at lower energy levels when less lumen output is required with the alternate lumen output levels, or some combination of both. For many applications this energy savings could translate to a significant reduction in costs.

Another advantage is the ability to provide an application with more consistent lumen output levels for its various needs. For high performance applications and situations, this more consistent light output can provide for a higher quality environment (e.g. better playability or spectator view or better television or film recording). For example, for tournament level play, LLD compensation will maintain a more consistent game to game (or season to season) illumination of the field, but the discretionary dimming allows for energy savings and environmental benefits for non-tournament game lighting (e.g. practice times). Analogous situations exist for other lighting applications and light sources.

A further advantage is that alternate lumen output levels can prevent over lighting of an application. In traditional lighting systems, applications may be over-lit by up to 30% to account for the expected lumen depreciation. Example 4 can light an application at 10% or less above the lumen output requirement and periodically adjust the lumen output when the light source depreciates to minimum acceptable lumen output levels. This results in a substantial energy savings as well as extended operational life of the light sources. Over the normal several thousand hour expected operating life of each such lamp, this savings starts to add up per lamp. And if used for the normal life of these types of systems (at least several decades), it can represent a substantial savings. See also the Table regarding "Light Level Options" above.

Another advantage is the ability of this invention to increase the effective life span of light sources. For many light sources, operating at lower energy levels facilitates the light source having a longer effective life span. A prime example of this phenomenon is solid state light sources, where reducing operating current can result in increasing the effective lifespan by thousands of hours as well as increase the lumen efficiency. This has obvious cost savings associated with the light source itself, as well as the cost and man hours devoted to physically changing the light sources.

e) Options/Alternatives

1. Generally

The foregoing versions of the discretionary dimming example 4 are made for illustration only, and not to limit the invention. Variations obvious to those skilled in the art are included with the invention. A few examples are given below.

2. Light Sources

The invention is believed relevant to any light source where the light source's lumen output varies as a function of some controllable factor[s], or which displays a lumen depreciation characteristic. This includes many forms of lighting including, but not limited to, HID, fluorescent, halogen, solid-state, and incandescent.

3. Timer[s]

In this example, time is used as a useful metric to measure or approximate any process that occurs at a known, predictable, or measurable rate within some reasonable bounds. In this fashion time can be used to approximate the LLD due to one or more variables because the depreciation which is at least partially dependent on those variables occurs at some known, measurable, or predictable rate within some bounds. These rates could be variable, but as long as the variations are known, measurable, or predictable with some bounds it is possible to account for those variations and maintain a level of accuracy.

Types of timers could range from, but are not limited to, electronic, solid state, mechanical, electro-mechanical, atomic, or others known in the art. It is envisioned that sensors whose primary purpose is not to measure the passage of time, could still be useful in measuring time in the context of this invention. For example, a sensor that measures charge flux through a cross sectional area would not necessarily be considered a timer by some, but if the current through the area was known to be steady within some bounds, the charge through that given area would accumulate at some predictable rate. In this fashion, a sensor which is not obviously a conventional timer, is useful in approximating the passage of time and is considered a timer in the context of invention.

There are circumstances where full power (higher light level) are not needed. There can be issues of sufficient power for start-up (e.g. with at least some HID lamps), but these can be addressed by starting the lamp with sufficient start-up power and then reducing power (and this lumen output) a reasonable amount for the lamp. For example, the system can require full power start up, but have a timer that releases the system to discretionary dimming or power reduction after a sufficient start-up period (e.g. 10 minutes to stabilize operation of the lamp).

4. Method of Adjusting Lumen Output

Many light sources can operate within a range of lumen outputs. In many cases there exists a range of lumen outputs where the lumen output is at least partially proportional to some controllable factor[s], for example, applied current, voltage, or power to the light source. How lumen output for these light sources varies as a function of this controllable factor[s] is often known in the art or able to be approximated through empirical testing. Through knowledge of the relationship between this controllable factor[s] and lumen output, it can be approximated how much to adjust the controllable factor[s] to achieve a particular lumen output. This controllable factor[s] can be adjusted in the process of at least partially compensating for lumen depreciation, for adjusting the lumen output for aesthetic purposes, adjusting the lumen output for power saving considerations, or for any other reason a user would opt to adjust the lumen output of a light source.

5. Method of Setting Power Changes

Selection of the times to change power can vary according to desire or need. In most cases, the pattern of lumen depreciation for a particular light source is at least partially dependent on a set of known variables. In many cases one variable, time of operation, dominates the function and can be used to accurately predict lumen depreciation. Manufacturers and other entities or organizations often produce information showing lumen depreciation for a particular light source, over time, based on a number of variables, including: power, voltage, amperage, temperature, and other factors that have a relevant impact on the light source's lumen depreciation. Even when this information is not readily available, it is still often known what variables weigh on lumen depreciation for the particular light source, and an approximation of a lumen depreciation curve can be developed through empirical testing. With this information it is possible to approximate how changes in the controllable factor[s] will change lumen output of the light source.

Using a particular light source's lumen depreciation curve or maintenance factor, it is possible to approximate at what operating time a light source's lumen output will depreciate to some predetermined point where the user of the lighting system would like to restore light level to, or near to, its original level. This point can vary for different applications, users, times, or other factors. A time is predicted when lumen output from the light source(s) will reach this point, and the lumen output for the light source(s) is corrected to, or near to, the original level by adjusting the controllable factor such that it will result in approximately the necessary change in lumen output for the light source.

It is also possible to adjust the lumen output of a given light source for reasons other than compensating for lumen depreciation, such as for alternate lumen output levels. It may also be advantageous to adjust the lumen output of the light source and simultaneously compensate for lumen depreciation where alternate lumen output levels need to be more consistent. Using the lumen depreciation characteristics of a particular light source, and the relationship between the light source's lumen output and some controllable factor[s], alternate lumen output levels can be achieved by adjusting the controllable factor[s] in the necessary fashion. These alternate lumen output levels can be engaged switchably, through use of timer[s], or some combination of both.

6. Change of Lumen Output

The method to change lumen output depends on the controllable factor[s] used to adjust the lumen output. Adjustment methods can be dictated by the controllable factor[s] that is being manipulated. For example, temperature, voltage, power, and amperage could be adjusted using means and methods known in the art to alter the lumen output of light sources which are at least partially dependent on one or more of these factors.

For HID light sources, adjustment methods are described in Gordin 635 and Gordin 718. For many light sources where supplied power, voltage, or current is a controllable factor for lumen output, various forms of modulation, including but not limited to amplitude, pulse width, pulse shape, frequency, and combinations of each, are effective at manipulating these factors. For some light sources, minimum power, voltage, or current levels may need to be maintained and the waveform may need to have minimum amplitude.

7. Implementation of Time Based Lumen Output Adjustments

As discussed earlier, nearly any apparatus or method of measuring or approximating the passage of time is applicable as a timer in this invention. More specific time mechanisms are outlined in Gordin 635. In one embodiment, a microprocessor can be operably connected to a timer[s], electronic storage device[s], wireless or wired communication device[s], sensor[s], switch[es], contactor[s], or a variety of devices. This microprocessor could be instructed, whether by remote signal or internal operating code, to adjust controllable factors based on pre-set schedules, information from sensor[s], or other information.

8. Lighting Systems

As discussed earlier, it is to be understood that the apparatus and method for discretionary adjustment of lumen output can be utilized with a single lamp or light source or with plural lamps or light sources. A circuit can be used with each lamp or light source or a circuit can be shared, at least in part, by plural lamps or light sources. For example, reference to U.S. Pat. No. 4,994,781 shows how a plurality of lamps can be discretionarily dimmed by a shared circuit. Those skilled in the art can apply analogous circuit sharing for plural lamps or light sources for the discretionary lumen output adjustment for LLD compensated lamps or light sources described herein.

As can be further appreciated, these embodiments can be applied to a plurality of lamps or light sources that are used in a coordinated lighting system where the lamps or light sources together are installed, configured, and aimed to compositely illuminate a target area or space according to minimum intensity and/or uniformity requirements. The GMLR and other light level or other requirements can therefore be for a relatively distant target area or space, as opposed for some measure of lumen output at or near the lamp. However, those skilled in the art can derive correlations between lumen output for one or more lamps or light sources measured at the sources and an intensity requirement at a relatively distant target.

9. Additional Options

FIG. 17 shows a possible additional option. Multiple dimming levels can be made available by having a plurality of individually selectable capacitors Cap 5, Cap 6, and Cap 7 (or more). The values can be selected according to the levels of dimming desired. Also, FIG. 17 shows that LLD compensation can be selected or not for any of the dimmed levels. By operating contactors 503A, B and C appropriately, the LLD compensation capacitors and timer can either be allowed to operate during any dimming period, or they can be bypassed. FIG. 18 is similar to the flow chart of FIG. 16 but shows the added option of allowing LLD compensation or not for any dimmed level.

What is claimed is:

1. A method for adjusting lumen output of a light source having a lamp lumen depreciation characteristic, the lumen output being at least partially dependent on a factor, wherein the factor is controllable, comprising:

a. obtaining data regarding the lumen depreciation characteristic of the light source over time;

b. obtaining information regarding the lumen output response of the light source to changes in the controllable factor;

c. identifying lumen output requirements;

d. predicting at least one operating time to increase lumen output using the lumen depreciation data;

e. monitoring the operating time of the light source; and f. adjusting the controllable factor with the actuator such that lumen output is adjusted to at or near a target level, wherein the adjustment to the controllable factor is based on the information regarding the relationship between the controllable factor and lumen output.

2. The method of claim 1 wherein the at least one operating time is determined from the light source's lumen depreciation characteristic.

3. The method of claim 1 wherein a timer or switch can select alternate lumen levels.

4. The method of claim 1 wherein the target lumen level is periodically adjusted.

5. The method of claim 1 wherein the operation level of the controllable factor is at least partially selected to realize an energy savings.

6. The method of claim 1 wherein there is a delay between adjustments to the controllable factor.

7. The method of claim 1 wherein the light source is chosen from the set comprising high intensity discharge (HID), fluorescent, halogen, solid-state, or incandescent light sources.

8. The method of claim 1 wherein the adjusting can be done remotely from the light source.

9. The method of claim 1 further comprising monitoring or sensing the light source and adjusting based on information from the monitoring or sensing.

10. The method of claim 1 wherein adjustments to the controllable factor are made using one or more modulations from the set comprising: pulse width, amplitude, or frequency.

11. The method of claim 1 wherein the timing comprises mechanical, electrical, or electro-mechanical timing.

12. The method of claim 1 wherein the controllable factor is current supplied to the light source.

13. The method of claim 1 wherein the controllable factor is power supplied to the light source.

14. The method of claim 1 wherein the controllable factor is voltage supplied to the light source.

15. The method of claim 1 wherein power supplied to the light source is at least partially dependent on capacitors.

16. The method of claim 1 wherein capacitance is added or deleted to adjust the power supplied to the light source.

17. The method of claim 1 wherein the controllable factor has a direct impact on the current, voltage, or power applied to the light source.

18. The method of claim 1 wherein the light source is elevated and used for wide area lighting.

19. The method of claim 1 wherein the light source is operatively connected to a ballast through which electrical energy is supplied to the light source.

20. The method of claim 1 wherein the light source is initially operated with lower power than is typical for the light source.

21. A method of operating a light source having a lumen depreciation characteristic comprising:

a. specifying a desired light output from the light source;

b. reducing actual operating wattage below rated operating wattage during an initial period of operation but maintaining approximate desired level output;

c. at several spaced apart times, increasing actual operating wattage an amount to restore light output to desired light output to compensate for lumen depreciation;

d. so that desired light output is reasonably consistent, but energy consumption is reduced, through the operating life of the light source.

22. The method of claim 21 wherein reducing and increasing actual operating wattage is instructed by an electronic controller.

23. The method of claim 21 wherein the timing device comprises an electronic controller, computer, or microprocessor.

* * * * *

UNITED STATES PATENT AND TRADEMARK OFFICE

CERTIFICATE OF CORRECTION

PATENT NO. : 8,098,024 B1
APPLICATION NO. : 13/092674
DATED : January 17, 2012
INVENTOR(S) : Myron Gordin It is certified that error appears in the above-identified patent and that said Letters Patent is hereby corrected as shown below:

In the Specifications:

Col. 1, Line 12: should ADD after 7,956,551 --issued on June 7, 2011--

Col. 2, Line 52: "initial" should be changed to --initially-- and delete "mean"

Col. 2, Line 53: should ADD before when --on average--

Col. 2, Line 55: "initial" should be changed to --initially-- and "mean" should be changed to --on average--

Col. 3, Line 20: should ADD after fixtures --containing lower power lamps--

Col. 3, Line 38: should ADD before elevating --massive-- and "structure" should be changed to --structures or fewer--

Col. 5, Line 64: "®" should be changed to --™--

Col. 6, Line 2: "®" should be changed to --™--

Col. 7, Line 65: "spaced" should be changed to --spaced-apart--

Col. 9, Line 35: "Smart Lamp™" should be changed to --SMART LAMP®--

Col. 9, Line 38: "Smart Lamp™" should be changed to --SMART LAMP®--

Col. 11, Line 25: "hand full" should be changed to --handful--

Col. 12, Line 35: "36" should be changed to --38--

Col. 14, Line 11: "as" should be changed to --has--

Col. 14, Line 13: should ADD after completed --(step 230, Fig. 2)--

Col. 14, Line 34: "1150" should be changed to --1050-- and "No." should be changed to --no.--

Col. 14, Line 35: "1300" should be changed to --1155--

Col. 14, Line 36: "1450" should be changed to ---~1270--

Signed and Sealed this
Third Day of September, 2013

Teresa Stanek Rea
*Acting Director of the United States Patent and Trademark Office*

Col. 14, Line 37: "1500" should be changed to --~1398--

Col. 15, Line 58: should ADD after towards --its-- and ADD after because --the--

Col. 15, Line 59: "anyways" should be changed to --anyway--, "overdrive" should be changed to --overdriving--, and should ADD after towards --the--

Col. 15, Line 60: "do not need to start out at too low" should be changed to --the bump down in-- and ADD after wattage --could be reduced--

Col. 15, Line 61: "or" should be changed to --and--

Col. 15, Line 62: "effect" should be changed to --affect--

Col. 15, Line 64: "preferably" should be changed to --preferable--

Col. 15, Line 65: ADD after between --the--

Col. 15, Line 66: DELETE after wattage; "do" and after not "go"

Col. 15, Line 67: ADD after of --the--, DELETE after lamp; "do" and after not "go"

Col. 16, Line 1: "effect" should be changed to --affect--

Col. 16, Line 2: ADD after with --the--

Col. 16, Line 6: "the" should be changed to --to provide functionality for-- and DELETE after switching "is needed"

Col. 16, Line7: ADD after after --the--

Col. 16, Line 8: ADD before balance --a-- and ADD after at the

Col. 16, Line 9: ADD before initial --the--

Col. 16, Line 14: ADD after times --one--, ADD after replace --the lamp-- and ADD after because --lamp--

Col. 16, Line 15: ADD after enough --light--, ADD after Here, a lamp, and "run" should be changed to --runs--

Col. 16, Line 16: ADD after until --it--, "to" should be changed to --at least--, and ADD after nearer --the--

Col. 18, Line 29: ADD after L2 --L3-- and "A and B" should be changed to --A, B and C--

Col. 18, Line 33: "A and B" should be changed to --A, B and C--

Col. 18, Line 55: The first "11" should be changed to --13-- and "FIGS. 10 and 11" should be changed to --FIGS. 10, 11 and 13--

Col. 21, Line 23: "1400" should be changed to --1460--

Col. 24, Line 39: ADD after 2000 --(now issued U.S. Patent No. 6,681,110)--

Col. 24, Line 50: "CONTROL LINK™" should be changed to --CONTROL-LINK®--

Col. 25, Line 7: "of" should be changed to --for--

Col. 25, Line 9: "power. Alternatively" should be changed to --power; alternatively,-- and ADD after contactor --could be used for auxiliary power--

Col. 26, Line 47: DELETE before each "that"

Col. 26, Line 50: "like a saw-teeth. It would" should be changed to --like saw-teeth (see, for example, Fig. 4). Light output from lamp 10 would--

Col. 26, Line 53: ADD after on --over time--

Col. 26, Line 54: DELETE after lampes "designed to"

Col. 32, Line 55: "MULTIWATT™" should be changed to --MULTI-WATT™--

Col. 32, Line 58-59: "MULTIWATT™" should be changed to --MULTI-WATT™--

Col. 33, Line 40: "my" should be changed to --may--

Col. 33, Line 41: "characteristic" should be changed to --characteristics--

Col. 33, Line 65: "than" should be changed to --then--

Col. 34, Line 9: "SMARTLAMP™" should be changed to --SMARTLAMP®--

Col. 34, Line 50-51: "SMARTLAMP™" should be changed to --SMARTLAMP®--

Col. 34, Line 54: "SMARTLAMP™" should be changed to --SMARTLAMP®--

Col. 35, Line 8: "SMARTLAMP™" should be changed to --SMARTLAMP®--

Col. 35, Line 16-17: "MULTI-WATT®" should be changed to --MULTI-WATT™--

Col. 35, Line 19: "MULTI-WATT®" should be changed to --MULTI-WATT™--

Col. 35, Line 31: "MULTI-WATT®" should be changed to --MULTI-WATT™--

Col. 35, Line 45: ADD after reach --(step 320)--

Col. 35, Line 61: "SMARTLAMP™" should be changed to --SMARTLAMP®--

Col. 36, Line 6: ADD after A1 --(see steps 336-348)--

Col. 36, Line 24-25: "SMARTLAMP™" should be changed to --SMARTLAMP®--

Col. 36, Line 28: "304B" should be changed to --304N-- and ADD after FIG. 16) --and steps contained therein (i.e. steps 356-368)--

Col. 36, Line 66: "560-568" should be changed to --350-368--

Col. 36, Line 67: "560-568" should be changed to --350-368--

Col. 40, Line 11: "4,994,781" should be changed to --4,994,718--

Col. 40, Line 33-34: "( or more)." should be changed to --or more-- and ADD before The --(see reference nos. 301A-C).--

Col. 40, Line 37: "503" should be changed to --502--

Col. 40, Line 39: ADD after bypassed --(similar to what is illustrated in Figs. 14 and 15)--

UNITED STATES PATENT AND TRADEMARK OFFICE

CERTIFICATE OF CORRECTION

PATENT NO. : 8,098,024 B1
APPLICATION NO. : 13/092674
DATED : January 17, 2012
INVENTOR(S) : Myron Gordin It is certified that error appears in the above-identified patent and that said Letters Patent is hereby corrected as shown below:

In the Claims

Col. 40, Claim 1, Line 58:

DELETE after with "the"

ADD after with --an--

Signed and Sealed this
Twenty-second Day of July, 2014

Michelle K. Lee

Michelle K. Lee
*Deputy Director of the United States Patent and Trademark Office*